US009897941B2

(12) United States Patent
Oshima et al.

(10) Patent No.: US 9,897,941 B2
(45) Date of Patent: Feb. 20, 2018

(54) DEVELOPING APPARATUS, PROCESS CARTRIDGE AND IMAGE FORMING APPARATUS

(71) Applicant: CANON KABUSHIKI KAISHA, Tokyo (JP)

(72) Inventors: Nobuo Oshima, Inagi (JP); Takayuki Namiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/267,262

(22) Filed: Sep. 16, 2016

(65) Prior Publication Data

US 2017/0090351 A1 Mar. 30, 2017

(30) Foreign Application Priority Data

Sep. 30, 2015 (JP) ..... 2015-195428

(51) Int. Cl.
*G03G 15/09* (2006.01)

(52) U.S. Cl.
CPC ..... *G03G 15/0921* (2013.01)

(58) Field of Classification Search
CPC ..... G03G 15/0921
See application file for complete search history.

(56) References Cited

U.S. PATENT DOCUMENTS

2014/0029986 A1* 1/2014 Maruyama ..... G03G 15/0189 399/277

FOREIGN PATENT DOCUMENTS

| | | | |
|---|---|---|---|
| JP | 2006-091247 | A | 4/2006 |
| JP | 4532996 | B2 | 8/2010 |
| JP | 2015-141379 | A | 8/2015 |

* cited by examiner

*Primary Examiner* — Hoang Ngo
(74) *Attorney, Agent, or Firm* — Fitzpatrick, Cella, Harper & Scinto

(57) ABSTRACT

With a first line segment being a line segment that joins an axis line of a developer carrier and an axis line of an image carrier, a second line segment being a line segment that joins a position, which is a position on the surface of the developer carrier at which the magnetic flux density of a magnetic pole is maximal, and the axis line of the developer carrier, and a third line segment being a line segment that joins a downstream end portion, in a rotation direction of the developer carrier, then among angles in the rotation direction of the developer carrier, a first angle formed by the first line segment and the second line segment is larger than 0° and equal to or smaller than a second angle formed by the first line segment and the third line segment.

24 Claims, 20 Drawing Sheets

DEVELOPING APPARATUS, PROCESS CARTRIDGE AND IMAGE FORMING APPARATUS

BACKGROUND OF THE INVENTION

Field of the Invention

The present invention relates to a developing apparatus that develops an electrostatic latent image formed on a photoconductor drum, to a process cartridge that forms a toner image and that is attachable/detachable to/from the apparatus body of an image forming apparatus, and to an image forming apparatus that relies on electrophotography.

Description of the Related Art

In electrophotographic image forming apparatuses relying on electrophotography, a photoconductor drum and a process means that acts on the photoconductor drum may be configured together in the form of an integrated process cartridge. The process cartridge can be attached/detached to/from the apparatus body of the image forming apparatus. Such process cartridge schemes are more convenient in that the user his/herself can service the image forming apparatus, without depending on a service man. Accordingly, process cartridge schemes have come to be widely used in image forming apparatuses.

The process cartridge is provided with a developing apparatus that develops an electrostatic latent image formed on the photoconductor drum. The developing apparatus supplies toner to the electrostatic latent image formed on the photoconductor drum, as a result of which the electrostatic latent image becomes developed in the form of a toner image. Schemes for developing electrostatic latent images on photoconductor drums include jumping development schemes. In a jumping development scheme, magnetic toner is caused to fly through change of the electric field between the photoconductor drum and a developing roller. Specifically, magnetic toner is caused to fly by finely modifying the strength of the electric field. In a jumping development scheme, toner degradation can be suppressed since the photoconductor drum and the developing roller do not come into contact with each other, and toner is not rubbed between the photoconductor drum and the developing roller.

A demand has arisen in recent years towards reducing the amount of toner that is consumed in order to form an image. Specifically, an identical amount of toner is required to allow printing a larger number of images. Doing so allows reducing the size of the container in which toner is held, and, in consequence, reducing the size of the image forming apparatus. In a jumping development scheme, as is known, a substantial amount of toner adheres to edge portions of electrostatic latent images on the photoconductor drum.

In consequence, the toner consumption amount tends to increase when images are formed that include numerous edges, for instance characters and fine lines. Herein FIGS. 9A and 9B are diagrams for explaining conventional jumping development. In some conventional instances, toner on the developing roller is immobilized in the form of "bristles" on account of the magnetic force of a magnet that is disposed inside the developing roller, as illustrated in FIG. 9A (hereafter, such "bristles" will be referred to as magnetic brush). The toner consumption amount at the edge portions is greater herein, since the entire magnetic brush on the developing roller becomes adhered, as it is, on the edge portions of the electrostatic latent image.

Therefore, in the technology disclosed in Japanese Patent No. 4532996, in order to reduce the toner consumption amount at edge portions, toner particles on the developing roller are not caused to move in the form of a magnetic brush, but separately as individual particles. A state in which toner particles on the developing roller are in the form of separate individual particles referred to as a cloud state. In the technology disclosed in Japanese Patent No. 4532996, the toner particles on the developing roller are brought to a cloud state, as illustrated in FIG. 9B, and the toner consumption amount at the edge portions of the electrostatic latent image is reduced as a result.

In the technology disclosed in Japanese Patent No. 4532996, however, fogging occurs when the process speed of the image forming apparatus is increased. To bring the toner particles on the developing roller to a cloud state in jumping development, a magnetic constraining force that the magnet within the developing roller exerts on the toner is made weaker, to bring about thereby a cloud state. The toner particles in the form of a cloud state move reciprocally between the photoconductor drum and the developing roller, and the electrostatic latent image on the photoconductor drum becomes developed as a result.

FIGS. 10A and 10B are diagrams for explaining the cause of fogging in jumping development. Flow of air occurs between the photoconductor drum and the developing roller due to rotation of the photoconductor drum and the developing roller. Such air flow does not affect the cloud-state toner when the process speed of the image forming apparatus is low and the rotational speed of the photoconductor drum and of the developing roller is low.

When the rotational speed of the photoconductor drum and of the developing roller increases, however, the influence on the cloud-state toner increases likewise. Individual toner particles have smaller mass than the magnetic brush, and hence toner particles in a cloud state are more affected by air flow than toner particles in a magnetic brush state.

Cloud-state toner particles that move reciprocally between the photoconductor drum and the developing roller move downstream, in the rotation direction of the photoconductor drum and the developing roller, on account of the air flow between the photoconductor drum and the developing roller. As a result, reciprocally moving toner particles that should return to the developing roller may in some instances fail to do so. The toner particles that do not return to the developing roller appear on the image in the form of fogging.

SUMMARY OF THE INVENTION

An object of the present invention is to provide a developing apparatus, comprising:

developer for developing an electrostatic latent image formed on an image carrier; and a developer carrier on which the developer is carried, and which is disposed across a space from the image carrier, a magnetic body having a magnetic pole being provided inside the developer carrier, and the developer carried on the developer carrier being caused to fly between the image carrier and the developer carrier, and to adhere to the electrostatic latent image, thereby developing the electrostatic latent image, wherein the developer is a magnetic one-component developer;

in a cross-section of the developer carrier and the image carrier as viewed in an axis line direction of the developer carrier, with a first line segment being a line segment that joins an axis line of the developer carrier and an axis line of the image carrier, a second line segment being a line segment that joins the axis line of the developer carrier and a position exhibiting, on the surface of the developer carrier, maximal magnetic flux density of the magnetic pole for carrying the developer on the developer carrier, at a position opposing the image carrier, a first region being a region on the image carrier at which the electrostatic latent image is developed, in a case where developer is caused to fly between the image carrier and the developer carrier when DC voltage identical to that during an image formation operation is applied to the developer carrier, with a potential of the image carrier set to 0 V, in a state where the image carrier and the developer carrier are not rotating, and a third line segment being a line segment that joins the axis line of the developer carrier and a downstream end portion, in a rotation direction of the developer carrier, of a second region which is a region on the developer carrier resulting from projecting, onto the developer carrier, the first region in a direction from the axis line of the image carrier towards the axis line of the developer carrier, then among angles in the rotation direction of the developer carrier, a first angle formed by the first line segment and the second line segment is greater than 0° and is equal to or smaller than a second angle formed by the first line segment and the third line segment.

Further features of the present invention will become apparent from the following description of exemplary embodiments (with reference to the attached drawings).

DESCRIPTION OF THE EMBODIMENTS

Embodiments of the present invention will be explained next with reference to accompanying drawings. The dimensions, materials, and shapes of constituent parts, relative arrangement of the constituent parts, and other features described in the embodiments are to be modified as appropriate in accordance with the configuration of the equipment to which the present invention is to be applied and in accordance with various other conditions, and do not constitute features that limit the scope of the invention to the embodiments that follow.

Example 1

<Configuration of an Image Forming Apparatus>

Figure 2:
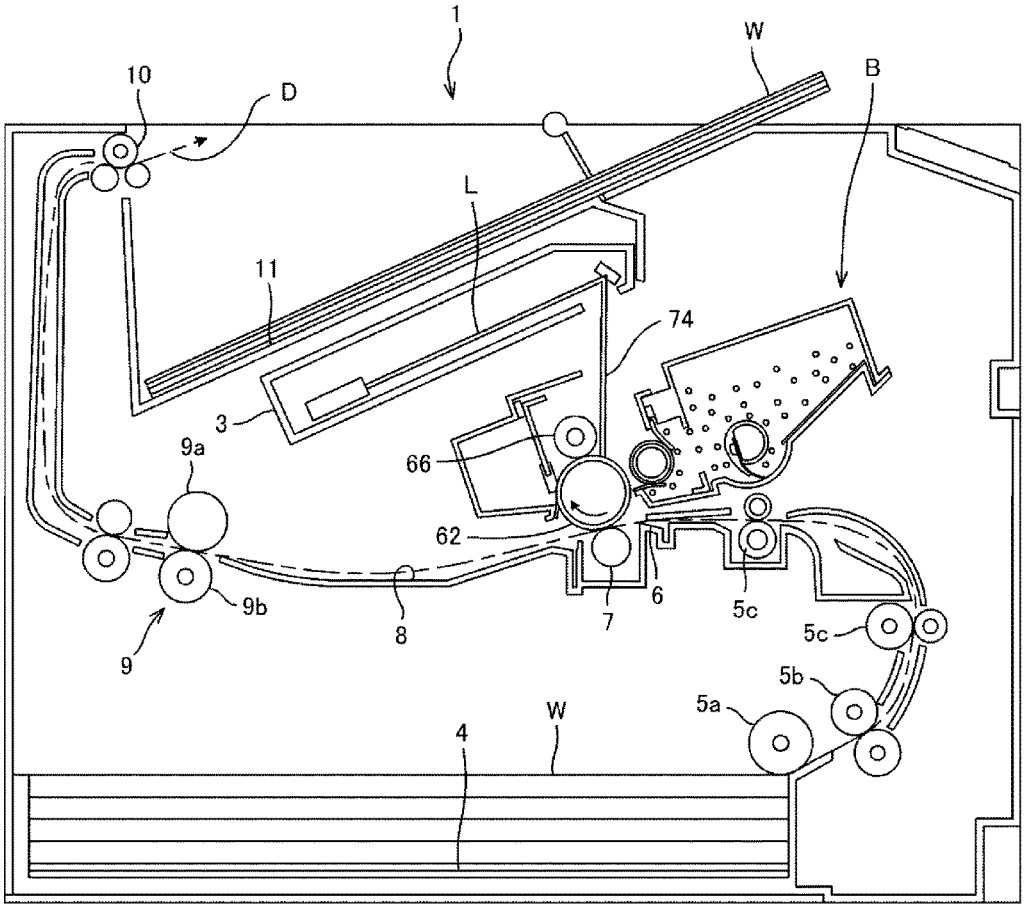
FIG. 2 is a schematic cross-sectional diagram illustrating an image forming apparatus according to Example 1.

FIG. 2 is a schematic cross-sectional diagram illustrating an image forming apparatus 1 according to Example 1. In FIG. 2 an image forming apparatus 1 that relies on electrophotography is a laser printer having an apparatus body A and a cartridge B. The cartridge B is attachable/detachable to/from the apparatus body A. When the cartridge B is attached to the apparatus body A, an exposure device 3 (laser scanner unit) is disposed above the cartridge B.

A sheet tray 4 that accommodates a sheet material W, as a recording medium on which images are formed, is disposed below the cartridge B. A pick-up roller 5*a*, a feeding roller pair 5*b*, a transport roller pair 5*c*, a transfer guide 6, a transfer roller 7, a transport guide 8, a fixing device 9, a discharge roller pair 10 and a discharge tray 11 are sequentially disposed in the apparatus body A, along a transport direction D of the sheet material W. The fixing device 9 has a heating roller 9*a* and a pressing roller 9*b*.

<Image Forming Process>

Figure 3:
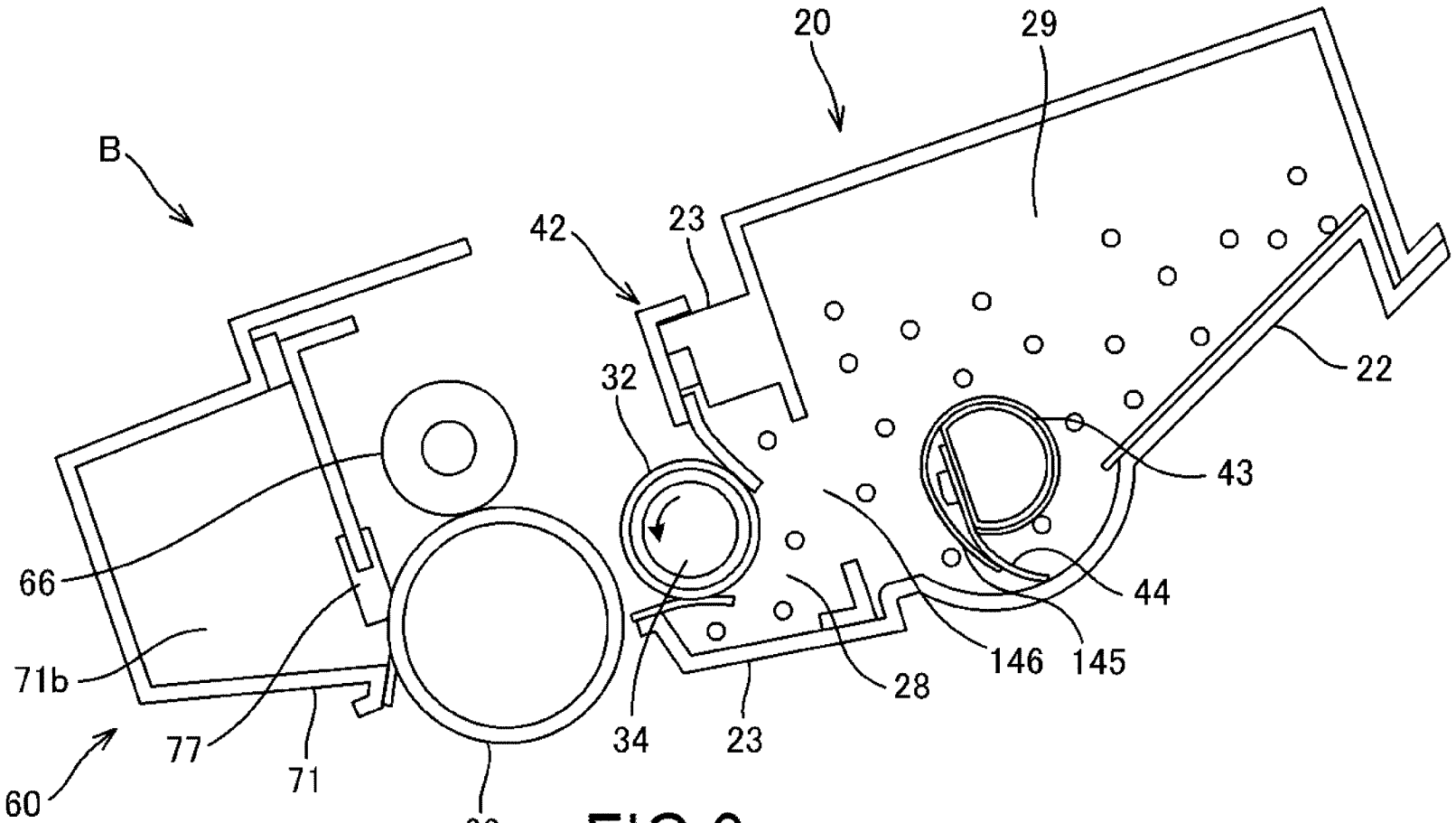
FIG. 3 is a schematic cross-sectional diagram illustrating a cartridge according to Example 1.

FIG. 3 is a schematic cross-sectional diagram illustrating the cartridge B according to Example 1. An image forming process will be explained next with reference to FIGS. 2 and 3. On the basis of a print start signal, a photoconductor drum 62 as an image carrier, having a diameter of 24 mm, rotates at a predetermined peripheral speed (process speed 100 mm/sec), in the arrow direction. A charging roller 66 having bias voltage applied thereto comes in contact with the outer peripheral surface of the photoconductor drum 62, and charges uniformly the outer peripheral surface of the photoconductor drum 62. The exposure device 3 outputs a laser beam L according to image information. The laser beam L passes through an exposure window portion 74 at the top face of the cartridge B, and the outer peripheral surface of the photoconductor drum 62 is scanned-exposed by the laser beam L. As a result, an electrostatic latent image corresponding to the image information becomes formed on the outer peripheral surface of the photoconductor drum 62.

Meanwhile, toner as developer, accommodated within the toner chamber 29 of a developing apparatus unit 20, as a developing apparatus, is stirred and transported by virtue of the rotation of a transport member 43, and is fed to a toner supply chamber 28, as illustrated in FIG. 3. The transport member has a sealing member 145 for sealing an opening 146 that is present between the toner chamber 29 and the toner supply chamber 28 of the developing apparatus unit 20. At the time of shipping of the equipment, the opening 146 is sealed, with toner accommodated in the toner chamber 29 alone, so as to prevent the toner in the toner chamber 29 from leaking between the toner accommodating frame 23 of the toner supply chamber 28 and the developing roller 32. During use, the transport member 43 is caused to rotate, as a result of which the opening 146 becomes unsealed through winding of the sealing member 145. The sealed opening 146 is depicted in an unsealed state in FIG. 3. The toner, being made up of a magnetic one-component, is carried on the surface of the developing roller 32 as a developer carrier, having a diameter of 10 mm, by virtue of the magnetic forces of a magnet roller 34 (fixed magnet) as a magnet being a magnetic body having a diameter of 8 mm. That is, the toner in the present example is a magnetic one-component developer. The developing roller 32 is acted upon by a drive force via a driving gear (not shown) of the photoconductor drum 62, and is rotationally driven as a result in the direction of the arrow at a peripheral speed that is 1.13 times the peripheral speed of the photoconductor drum 62. As illustrated in FIGS. 2 and 3, the rotation directions of the photoconductor drum 62 and of the developing roller 32, as viewed from one end of the rotation axis (axis line) of the developing roller 32, are mutually opposite. The developing blade 42 triboelectrically charges the toner, and restricts the thickness of a layer of toner on the surface of the developing roller 32. The toner becomes adhered to the electrostatic latent image on the photoconductor drum 62, and, as a result, the electrostatic latent image is made visible in the form of a toner image.

As illustrated in FIG. 2, the sheet material W accommodated at the bottom of the apparatus body A is fed out of the sheet tray 4 by the pick-up roller 5*a*, the feeding roller pair 5*b* and the transport roller pair 5*c*, according to the output timing of the laser beam L. The sheet material W is guided at the transfer guide 6 and is transported to a transfer position between the photoconductor drum 62 and the transfer roller 7. At the transfer position the toner image is transferred sequentially from the photoconductor drum 62 onto the sheet material W. The sheet material W having the toner image transferred thereonto is separated from the photoconductor drum 62 and is transported along the transport guide 8 towards the fixing device 9.

The sheet material W passes through a nip portion of the heating roller 9*a* and the pressing roller 9*b* that make up the fixing device 9. The toner image is pressed and heated at the nip portion, and becomes fixed as a result to the sheet material W. The sheet material W on which the toner image has undergone the fixing treatment is transported up to the discharge roller pair 10, and is discharged to the discharge tray 11 by the discharge roller pair 10. Meanwhile, the residual toner on the photoconductor drum 62 after transfer is removed by a cleaning blade 77, as illustrated in FIG. 3, and thereafter, the photoconductor drum 62 is used again in the image forming process. The residual toner having been removed from the photoconductor drum 62 is stored in a waste toner chamber 71*b* of a cleaning unit 60.

<Configuration for Cartridge Attachment and Detachment>

Figure 4:
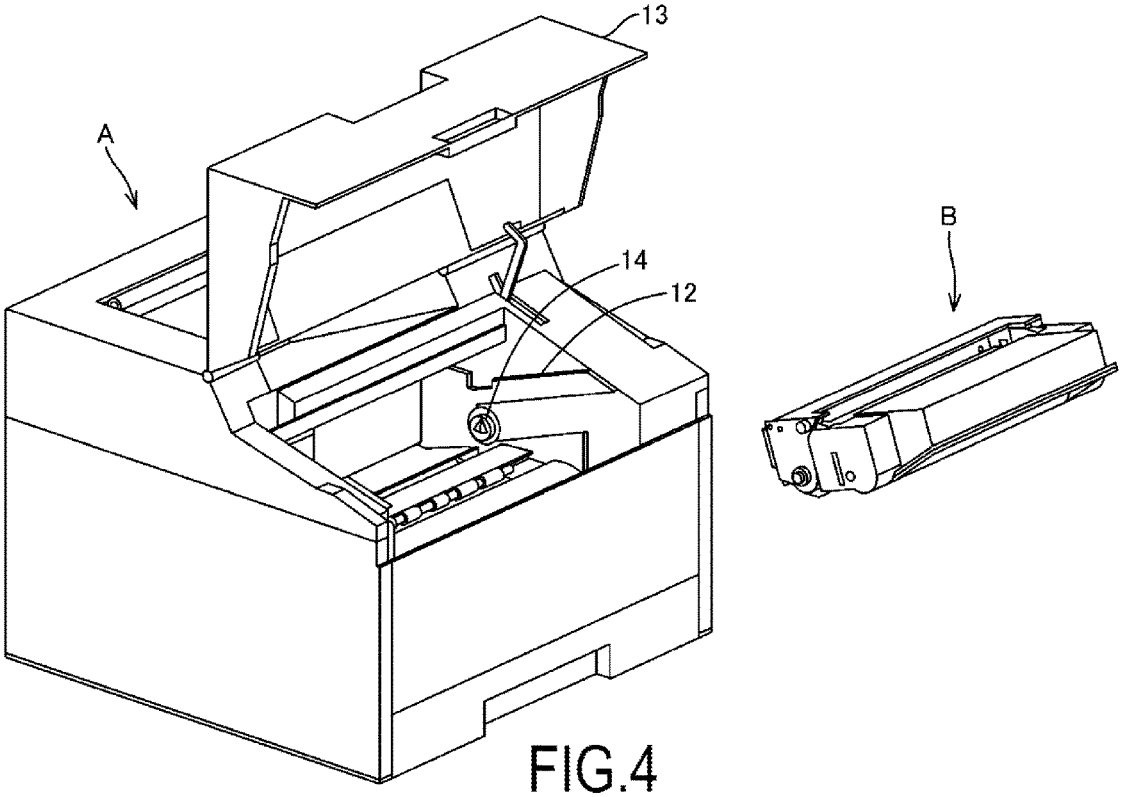
FIG. 4 is a diagram illustrating an apparatus body of the image forming apparatus according to Example 1.

Attachment and detachment of the cartridge B to/from the apparatus body A will be explained next with reference to FIG. 4. FIG. 4 illustrates the apparatus body A and the cartridge B of the image forming apparatus 1 according to Example 1. Specifically, FIG. 4 is a perspective-view diagram illustrating the cartridge B and the apparatus body A with an opening and closing door 13 that is opened in order to attach and detach the cartridge B as a process cartridge. The opening and closing door 13 is rotatably mounted to the apparatus body A. A guide rail 12 becomes exposed when the opening and closing door 13 is opened. The cartridge B is guided along the guide rail 12 and attached inside the apparatus body A. A drive shaft 14 that is driven by a motor (not shown) of the apparatus body A engages with a drive force-receiving portion 63*a* that is provided in the cartridge B. As a result, the photoconductor drum 62 that is engaged with the drive force-receiving portion 63*a* rotates when receiving the drive force from the apparatus body A.

<Overall Cartridge Configuration>

Figure 5:
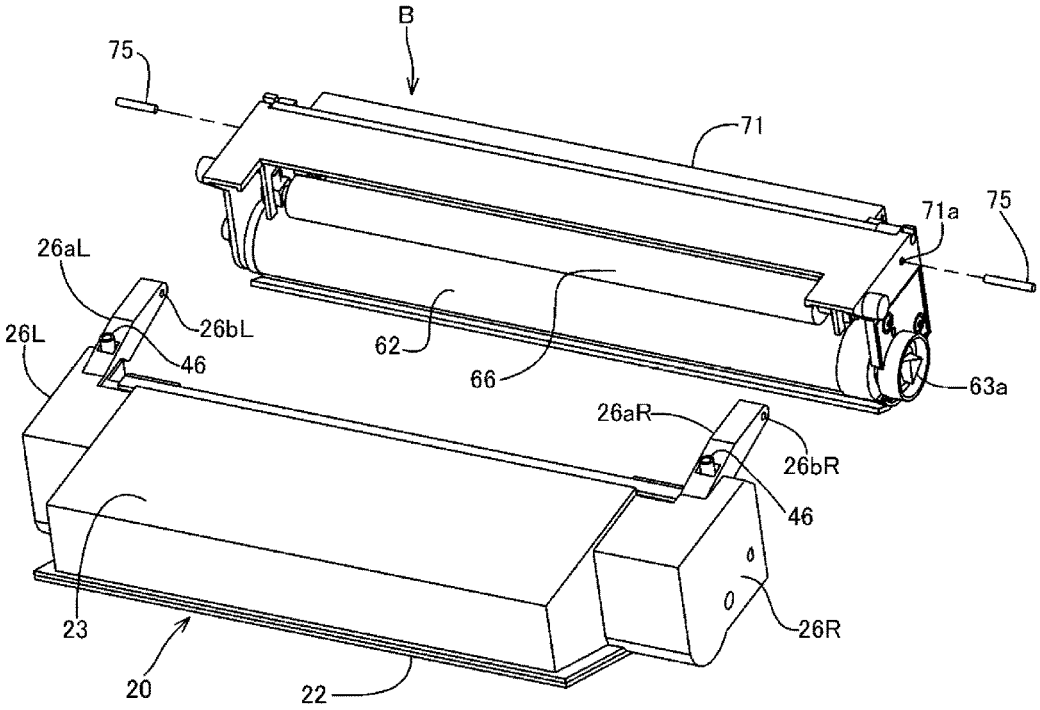
FIG. 5 is an exploded perspective-view diagram of the cartridge according to Example 1.

The overall configuration of the cartridge B will be explained next with reference to FIGS. 3 and 5. FIG. 5 is an exploded perspective-view diagram of the cartridge B according to Example 1. The cartridge B is configured in the form of a combination of the cleaning unit 60 and the developing apparatus unit 20. The cleaning unit 60 has a cleaning frame 71, the photoconductor drum 62, the charging roller 66 and the cleaning blade 77.

The developing apparatus unit 20 has the lid member 22, the toner accommodating frame 23, a first side member 26L, a second side member 26R, the developing blade 42, the developing roller 32, the magnet roller 34, a toner stirring sheet 44 and urging members 46. The cartridge B is configured through coupling of the cleaning unit 60 and the developing apparatus unit 20 by a coupling member 75, in such a manner that the cleaning unit 60 and the developing apparatus unit 20 can pivot with respect to each other.

A pivot hole 26*b*L is provided at the tip of an arm portion 26*a*L of the first side member 26L, being one end portion of the developing apparatus unit 20 in the longitudinal direction. A pivot hole 26*b*R is provided at the tip of an arm portion 26*a*R of the second side member 26R being the other end portion of the developing apparatus unit 20 in the longitudinal direction. Fitting holes 71*a* for fitting the coupling member 75 are formed at both end portions of the cleaning frame 71 in the longitudinal direction.

The arm portion 26*a*L, the arm portion 26*a*R and the cleaning frame 71 are held at predetermined positions, and the coupling member 75 is inserted into the fitting hole 71*a* via the pivot hole 26*b*L and the pivot hole 26*b*R. As a result, the cleaning unit 60 and the developing apparatus unit 20 become coupled pivotably about the coupling member 75. The urging members 46 provided at the roots of the arm portion 26*a*L and the arm portion 26*a*R come then into contact with the cleaning frame 71, and the cleaning unit 60 is urged as a result. This has the effect of pushing reliably the developing roller 32 towards the photoconductor drum 62.

<Magnetic Flux Density and Magnetic Pole Arrangement in the Magnet Roller 34>

Figure 6A:
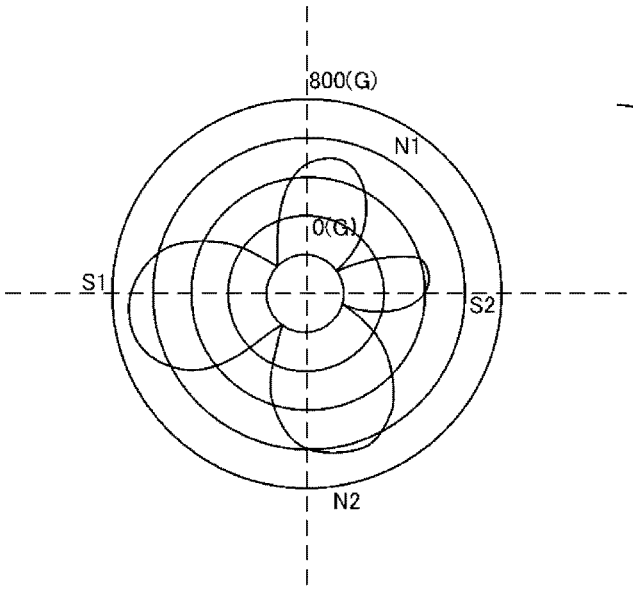
FIGS. 6A and 6B are diagrams illustrating magnetic forces and the arrangement of magnetic poles in a magnet according to Example 1.
Figure 6B:
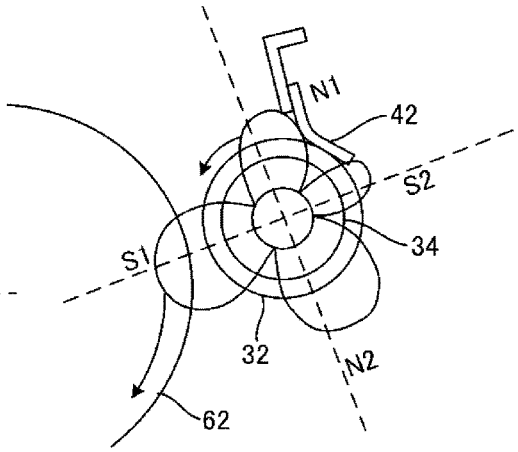

The magnetic flux density and the magnetic pole arrangement in the magnet roller 34 that is used in the present example will be explained next with reference to FIGS. 6A and 6B. FIGS. 6A and 6B are diagrams illustrating magnetic forces and the arrangement of magnetic poles in the magnet roller 34 according to Example 1. FIG. 6A illustrates the magnetic forces and the arrangement of magnetic poles in the magnet roller 34. FIG. 6B illustrates the arrangement of magnetic poles with respect to the cartridge B. The diagrams depict magnetic forces (magnetic flux density) in the normal direction.

The magnet roller 34 (fixed magnet) having a diameter of 8 mm and inserted in the interior of the developing roller 32 having a diameter of 10 mm is made up of four magnetic poles (magnetic pole S1, magnetic pole S2, magnetic pole N1 and magnetic pole N2). The magnetic pole S1, as a facing magnetic pole, is a developing pole for carrying toner on the developing roller during developing. The magnetic pole S2 is a magnetic pole for carrying the toner within the developing container onto the developing roller 32 (corresponding to the developer carrier). The magnetic pole N1 is a magnetic pole for restricting, together with the developing blade 42, the thickness of the toner layer on the developing roller 32, and the magnetic pole N2 is a magnetic pole for preventing blow-out of toner from be low the developing roller 32. The toner carried on the developing roller 32 by virtue of the magnetic pole S2 is transported accompanying the rotation of the developing roller 32. The thickness of the toner layer is regulated to a desired thickness by the developing blade 42 and the magnetic pole N1, and the toner is transported to a position opposing the photoconductor drum 62. In the present example the peak magnetic flux density of the magnetic poles of the magnet roller 34 are set to be S1=700 G, S2=430 G, N1=540 G and N2=620 G.

<Jumping Development>

Figure 7A:
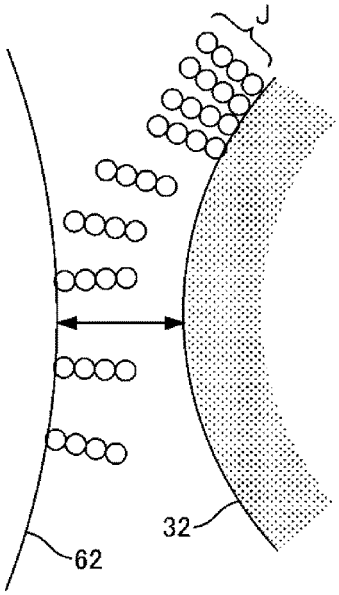
FIGS. 7A and 7B are diagrams for explaining conventional jumping development.
Figure 7B:
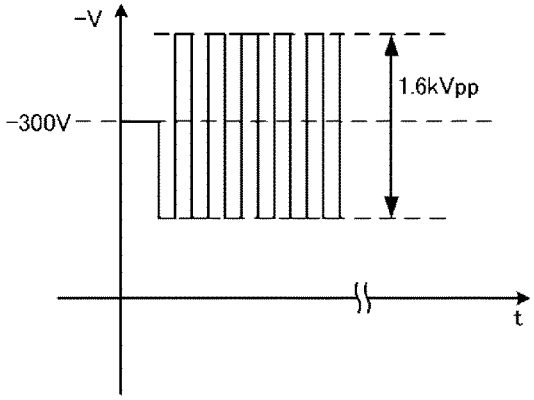

Jumping development will be explained next with reference to FIGS. 7A and 7B. In the present example the toner is carried on the developing roller 32 in a cloud state. In FIGS. 7A and 7B the toner is carried on the developing roller 32 in the form of a magnetic brush. Herein FIGS. 7A and 7B are diagrams for explaining conventional jumping development. FIG. 7A is a cross-sectional diagram of an enlarged gap being the space between the photoconductor drum 62 and the developing roller 32 of the cartridge B. FIG. 7B illustrates developing bias for performing jumping development.

The magnetic pole S1, being a developing pole, is at a position opposing the photoconductor drum 62; as a result, toner piles up along magnetic force lines and forms a magnetic brush J. A clearance of 300 μm is provided between the developing roller 32 and the photoconductor drum 62. In the present example, specifically, the size of the clearance formed between the developing roller 32 and the photoconductor drum 62 in a region at which the electrostatic latent image is developed is set to be greater than the height of the toner that is carried on the developing roller 32. As illustrated in FIG. 7B, developing bias in the form of a square wave of superimposed AC voltage and DC voltage is applied to the developing roller 32. While moving reciprocally between the developing roller 32 and the photoconductor drum 62, the toner on the developing roller 32 develops the electrostatic latent image on the photoconductor drum 62, in response to the potential difference between the developing roller 32 and the photoconductor drum 62. The developing bias in the present example is a square wave having AC voltage of 1.6 kVpp and frequency of 2.7 kHz, with DC voltage of −300 V. The potential of the surface of the photoconductor drum 62 after exposure is −120 V.

<Toner>

The toner according to the present example will be explained next. In a case where the electrostatic latent image is developed according to a jumping development method in which magnetic toner is used as a magnetic developer, a phenomenon (so-called edge effect) of increased toner consumption amount occurs ordinarily at the edge portions of the electrostatic latent image. Accordingly, toner consumption amount increases in images that include numerous edges, for instance characters and fine lines. This phenomenon occurs because the magnetic brush of toner on the developing roller 32 remains adhered to the edge portion and is not pulled back to the developing roller 32.

In the present example, therefore, the toner is caused to behave not as a magnetic brush but as individual particles (=developing in a cloud state), between the photoconductor drum 62 and the developing roller 32. This allows curtailing increases in the toner consumption amount at edge portions of the electrostatic latent image. In order to accomplish development using cloud-state toner, the magnetic brush of toner on the developing roller 32 must collapse readily, and the ability of toner to track developing bias must be high.

The smaller the residual magnetization of toner, the more readily the magnetic brush collapses as the toner moves reciprocally on account of the developing bias. Further, the smaller the toner particle size, the better is the trackability of toner towards developing bias. The smaller the toner particle size, the smaller becomes residual magnetization per toner particle, and hence the more readily the toner comes to a cloud state. Accordingly, it is preferable to limit the number-average particle size, the residual magnetization and the average circularity of the toner that is used in development, with a view to achieving development using cloud-state toner.

<Number-Average Particle Size and Residual Magnetization>

In order to accomplish development using cloud-state toner, $\sigma r \times D$ must lie in the range of 3.2 to 38.0, where D (μm) denotes the number-average particle size of the toner, and $\sigma r$ ($Am^2/kg$) denotes the residual magnetization of the toner in a magnetic field of 79.6 kA/m. Further, a $\sigma r \times D$ lies preferably in the range of 4.5 to 29.0, and more preferably of 4.5 to 16.0. By prescribing $\sigma r \times D$ to take on such values it becomes possible for toner to come readily to a cloud state and to reduce the toner consumption amount at the edge portions.

When the average circularity is 0.950 or higher and $\sigma r \times D$ is greater than 38.0, on the other hand, the toner behaves as a magnetic brush J in a developing region (first region) being the region developed by toner on the photoconductor drum 62. In a case where the average circularity is 0.950 or higher and a $\sigma r \times D$ is smaller than 3.2, the toner at the developing region comes to a cloud state, but fogging increases. In this case, the toner consumption amount at edge portions does not increase; however, the toner consumption amount does increase at non-image portions, which results in an increase in the toner consumption amount.

In order to develop yet smaller dots faithfully, the number-average particle size of the toner used in the present example is preferably somewhat small. If the number-average particle size is smaller than 3 μm, however, the flowability and stirrability of toner powder drops, and it becomes difficult to charge uniformly the individual toner particles. Moreover, the toner consumption amount increases due to increased fogging. Accordingly, the number-average particle size of the magnetic toner in the present example is preferably 3 to 9 μm, more preferably 4 to 9 μm.

The average particle size and granularity distribution of toner can be measured in accordance with various methods, for instance using a Coulter Counter model TA-II or Coulter Multisizer (by Beckman Coulter, Inc.). In the present example the above are measured using a Coulter Multisizer (by Beckman Coulter, Inc.). An interface (by Nikkaki Bios Co., Ltd.) that outputs a number distribution and a volume distribution, as well as a PC9801 personal computer (by NEC Corporation) are connected to the Coulter Multisizer. Herein a 1% NaCl aqueous solution prepared using first-grade sodium chloride can be used as the electrolyte solution. For instance ISOTON R-II (by Coulter Scientific Japan Co.) can be used in the case of Coulter Multisizer.

The measurement method involves adding 0.1 to 5 ml of a surfactant (preferably, alkylbenzene sulfonate), as a dispersant, to 100 to 150 ml of the above electrolytic aqueous solution, and further adding 2 to 20 mg of the measurement sample. The electrolyte solution having the sample suspended therein is subjected to a dispersion treatment for about 1 to 3 minutes in an ultrasonic disperser. The number of toner particles being 2 μm or larger in the resulting sample are measured using the Coulter Multisizer, with a 100 μm aperture. The number distribution is calculated thereby, to work out the number-average particle size (D).

The strength of saturation magnetization and residual magnetization of the magnetic toner are measured using a vibrating magnetometer VSM P-1-10 (by Toei Industry Co., Ltd.), at room temperature of 25° C. and under an external magnetic field of 79.6 kA/m. The magnetic force of the developing pole of the magnet roller 34 that is fixed inside the toner carrier is ordinarily of 1000 Oe (about 79.6 kA/m), and accordingly the toner behavior in the developing region can be grasped by measuring residual magnetization at an external magnetic field of 79.6 kA/m.

<Average Circularity>

Next, a study of the relationship between toner shape and cloud developing revealed that toner can easily come to a cloud state when the average circularity of the toner is 0.950 or higher (more preferably, 0.960 or higher and yet more preferably 0.970 or higher). The higher the circularity, the closer to spherical the shape is, and accordingly the closer the particles come to point-contact among them, and the more readily the magnetic brush collapses. It is deemed that toner comes as a result more readily to a cloud state. From the above it follows that the toner can behave as individual particles (=development in a cloud state) when D×σr is 3.2 to 38.0 and the average circularity of the toner is 0.950 or higher (0.95 or higher). Further, the toner consumption amount is reduced since the toner at edge portions is pulled back to the developing roller 32 neatly.

In the present example, average circularity is used as a simple method for representing quantitatively the shape of particles. Average circularity in the present example is measured using a flow-type particle image analyzer "FPIA-1000", by Toa Medical Electronics Co., Ltd. The circularity (Ci) of each particle measured in a particle group having a circle equivalent diameter of 3 μm or greater is worked out according to Expression (1) below. Average circularity (C) is defined as the value resulting from dividing the total sum of the circularities of all the measured particles by the total particle number (m), as given in Expression (2) below.

$$\text{Circularity } (Ci) = \frac{\text{circumference length of circle having same projected area as particle image}}{\text{circumference length of projected image of particle}} \quad (1)$$

$$\text{Average circularity } (C) = \sum_{i=1}^{m} Ci/m \quad (2)$$

After calculation of the circularity of the particles using the "FPIA-1000" as the measuring device, the particles are classified on the basis of circularity into 61 divisions of 0.01, from a circularity of 0.40 to 1.00, to calculate average circularity and mode circularity. The average circularity is calculated then using the center value of the point s of division and the frequency. However, the measurement error variances among the average circularity calculated in accordance with the present calculation method, the average circularity calculated on the basis of the above-described calculation expression using directly the circularity of each particle, and the mode circularity, is very small. Accordingly, the error is small enough to be substantially negligible, and thus in the present example a calculation method is resorted to that involves using a partially modified calculation expression in which the above-described circularity of the particles is utilized directly, for reasons of data handling in terms for instance of shortening the calculation time and simplifying arithmetic expressions.

The measurement procedure is as follows. About 5 mg of magnetic toner are dispersed in 10 ml of water having about 0.1 mg of surfactant dissolved therein, to prepare a dispersion. This dispersion is then irradiated with ultrasounds (20 kHz, 50 W) for 5 minutes. The dispersion concentration is set to 5000 to 20000/μl, and measurements are performed using the above-described apparatus, to work out the average circularity of a particle group having a circle equivalent diameter of 3 μm or greater. In the present example the average circularity is an index of the degree of unevenness of the magnetic toner. A perfectly spherical magnetic toner has an average circularity of 1.000; thus the more complex the surface shape of the magnetic toner, the smaller the average circularity becomes. In the present measurement method there is measured the circularity of only particle groups having a circle equivalent diameter of 3 μm or greater. External additives are present independently from toner particles in particle groups having a circle equivalent diameter smaller than 3 μm. In the present measurement method there is reduced the impact of external additives on particle groups, and hence the circularity of toner particles can be worked out more accurately.

<Method for Producing the Toner>

The magnetic toner of the present example can be produced in accordance with any known method. Firstly, in a case where the toner is produced in accordance with a crushing method, for instance a binder resin, a magnetic powder, a release agent, a charge control agent, a coloring agent and so forth as essential components of the magnetic toner, as well as other additives, are thoroughly mixed in a mixer such as a Henschel mixer or a ball mill. The resulting product is then melt-kneaded using a heating kneading machine such as a heating roll, a kneader or an extruder, to disperse or dissolve other magnetic toner materials such as the magnetic powder and so forth, in the compatibilized resin. Thereafter, the whole is solidified through cooling, is crushed and is classified, and subjected as needed to a surface treatment. Toner particles can be obtained as a result. Classification and surface treatment may each precede the other. A multi-division classifier is preferably used in the classification process, from the viewpoint of production efficiency.

The crushing process can be performed in accordance with a method that utilizes a known crushing apparatus of, for instance, mechanical impact type or jet type. In order to obtain toner having the specific circularity (0.950 or higher) according to the present example it is preferable to perform a crushing treatment while under heating, or to perform a treatment that involves accessorily applying mechanical impact. For instance a hot-water method may be resorted to in which pulverized (and as needed classified) toner particles are dispersed in hot water, or a method in which the toner particles are caused to pass through a hot air stream.

Examples of means for imparting mechanical impact forces include methods in which there is used a mechanical impact type crushing machine such as a Kryptron system by Kawasaki Heavy Industries, Ltd., or a Turbo-mill by Turbo Kogyo Co., Ltd. A further method involves using an apparatus for instance such as a Mechanofusion system by Hosokawa Micron Corporation, or a Hybridization system by Nara Machinery Co., Ltd. In this method, toner is pushed against the inner side of casing by virtue of centrifugal forces derived from vanes rotating a high speed, and mechanical impact forces are applied to toner in the form of forces such as compressive forces and frictional forces.

The magnetic toner of the present example can be produced in accordance with the crushing method described above, but toner particles obtained by such crushing are generally of indefinite shape. Productivity is poor herein in that a mechanical, thermal or some other special treatment is necessary in order to achieve the physical property of average circularity of 0.950 or higher, being a prerequisite of the toner according to the present example. Therefore, the toner of the present example is preferably produced in a wet medium by, for instance, dispersion polymerization, association-aggregation, or suspension polymerization. In particular, suspension polymerization is highly preferred since this method satisfies readily the preferred conditions of the present example.

In suspension polymerization, a polymerizable monomer and a coloring agent (and also, for instance, a polymerization initiator, a cross-linking agent, a charge control agent and other additives, as needed), are dissolved or dispersed uniformly, to yield a polymerizable monomer composition. Thereafter, the polymerizable monomer composition is caused to undergo a polymerization reaction simultaneously with dispersion, using an appropriate agitator, in a continuous layer (for instance, aqueous phase) containing a dispersion stabilizer. Toner having a desired particle size can be obtained as a result. The shapes of the individual toner particles of the toner obtained through such suspension polymerization (hereafter referred to as polymerized toner) are substantially equally spherical, with an average circularity of 0.970 or higher and circularity standard deviation of 0.045 or smaller. Therefore, a toner that satisfies the physical property requirements deemed suitable for the present example is obtained readily. Such a toner, moreover, allows reducing the toner consumption amount since the distribution of charge amount as well is relatively uniform.

A suspension polymerization method that allows producing suitably the magnetic toner of the present example will be explained next. To produce the polymerized toner according to the present example, the magnetic powder, a release agent, a plasticizer, a charge control agent, a cross-linking agent and, depending on the case, necessary components as a toner, for instance a coloring agent and so forth, are added to the polymerizable monomers that yield the binder resin. Other additives (for instance, a high molecular weight polymer, a dispersant or the like) are added as appropriate, and thereafter, the polymerizable monomer composition having been dissolved or dispersed uniformly using a disperser or the like, is suspended in an aqueous medium containing a dispersion stabilizer. The polymerized toner is produced as a result.

In the production of the polymerized toner according to the present example, polymerizable monomers that make up the polymerizable monomer composition include the following. Examples of polymerizable monomers include, for instance, styrenic monomers such as styrene, o-methyl styrene, m-methyl styrene, p-methyl styrene, p-methoxy styrene, p-ethyl styrene and the like, as well as methyl acrylate, ethyl acrylate and the like. Further examples include, for instance, n-butyl acrylate, isobutyl acrylate, n-propyl acrylate, n-octyl acrylate, dodecyl acrylate, 2-ethylhexyl acrylate, stearyl acrylate and the like. Further examples include, for instance, acrylic acid esters such as 2-chloroethyl acrylate, phenyl acrylate and the like, as well as methyl methacrylate, ethyl methacrylate, n-propyl methacrylate, n-butyl methacrylate, isobutyl methacrylate and the like. Yet further examples include, for instance, n-octylmethacrylate, dodecylmethacrylate, 2-ethylhexyl methacrylate, stearyl methacrylate, phenyl methacrylate, dimethylaminoethyl methacrylate and the like. Further examples include methacrylic acid esters such as diethylaminoethyl methacrylate, as well as acrylonitrile, methacrylonitrile, acrylamide and the like. These monomers can be used singly or in mixtures. Among the foregoing it is preferable to use styrene or styrene derivatives, singly or mixed with other monomers, from the viewpoint of developing characteristics and durability of the toner.

In the method for producing the magnetic toner according to the present example by polymerization, generally a product resulting from suitably adding the above-described toner composition and the like is dissolved or dispersed uniformly using a disperser such as a homogenizer, a ball mill, a colloid mill or an ultrasonic disperser. The polymerizable monomer composition obtained as a result is suspended in an aqueous medium containing a dispersion stabilizer. The particle size is achieved then at a stroke using a high-speed disperser such as high-speed stirrer or an ultrasonic disperser. This translates into a sharp particle size of the obtained toner particles. The polymerization initiator may be added simultaneously with addition of other additives to the polymerizable monomer, or may be mixed directly into the aqueous medium immediately before suspension. The polymerizable monomer, or the polymerization initiator dissolved in a solvent, can be added before the polymerization reaction immediately after particle granulation.

After particle granulation, the particle state is preserved using an ordinary stirrer; herein it suffices to stir the particles so as to prevent flotation or settling of the latter. In the polymerization step, polymerization is performed with the polymerization temperature set at 40° C. or above, generally in the range of 50 to 90° C. During polymerization within this temperature range, the release agent, wax and so forth that are to be confided in the interior of the toner precipitate inside the toner particles through phase separation, and become better encapsulated in the toner particles. In order to consume the residual polymerizable monomer, the reaction temperature can be raised to a temperature in the range of 90 to 150° C., at the final stage of the polymerization reaction.

After polymerization is over, the polymerized toner particles are filtered, washed and dried in accordance with known methods, and an inorganic fine powder is deposited on the surface of the toner particles, as needed. The magnetic toner of the present example is obtained as a result. The production process can include a classification step in which the toner is cut to a coarse powder or fine powder. In the present example, an inorganic fine powder having a number-average primary particle size in the range of 4 to 80 nm (more preferably, 6 to 40 nm) is preferably added, as a fluidizing agent, to the toner. The inorganic fine powder is added to the toner in order to improve toner flowability and to elicit uniform charging of the toner particles. It is preferable to impart the inorganic fine powder with a function of, for instance, adjusting the charge amount of the toner or enhancing environmental stability by subjecting the inorganic fine powder for instance to a hydrophobic treatment. The above production method al lows producing cloud-state toner. The toner consumption amount can be reduced as a result.

<Verification Experiment>

Table 1 sets out the relationship between number-average particle size, average circularity, value of residual magnetization, state of the magnetic brush, fogging, and toner consumption amount in various toners that were produced. An instance where the toner in the developing region flies in the state of the magnetic brush J is rated as poor (x), while an instance where toner flies in a cloud state, being a state in which the magnetic brush J has collapsed, is rated as good (○). The developing state of the toner was measured through observation of the developing region using a high-speed camera, in the cross-section direction. The value of toner consumption amount in Table 1 is a value resulting from dividing the toner amount consumed in an image output test of 2000 prints of an ISO image in continuous paper feed, in a normal-temperature normal-humidity environment (23° C. and 60% RH). Paper of 75 g/m$^2$ was used as the recording medium.

A solid white image was output in a normal-temperature normal-humidity environment (23° C. and 60% RH), and fogging was measured using a REFLECTMETER MODEL TC-6DS by Tokyo Denshoku Co., Ltd. A green filter is used as the filter, and the fogging amount is measured as fogging (reflectance) (%)=reflectance (%) of standard paper−reflectance (%) of solid white portion. The evaluation criterion of fogging is good (○) when fogging is lower than 2%, fair (Δ) when fogging is 2% to less than 2.5%, and poor (x) when fogging is 2.5% or higher. The magnetic pole S1 is disposed at a position opposing the photoconductor drum 62. The peak position of the magnetic flux density of the magnetic pole S1 opposes the central axis of rotation (axis line) of the photoconductor drum 62. The magnetic pole S1 is a magnetic pole that draws toner towards the developing roller 32. axis of rotation of the developing roller 32. A certain effect is elicited on fogging toner if the position of the magnetic pole lies downstream, even if the toner state is not good (○). Table 1 reveals that the toner consumption amount can be reduced in a case of development in a cloud state as compared with the consumption amount in development in a magnetic brush state.

<Problems Derived from Speed-Up>

Figure 8A:
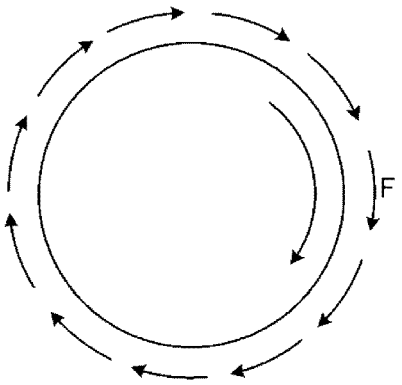
FIGS. 8A and 8B are diagrams illustrating air flow between a photoconductor drum and a developing roller.
Figure 8B:
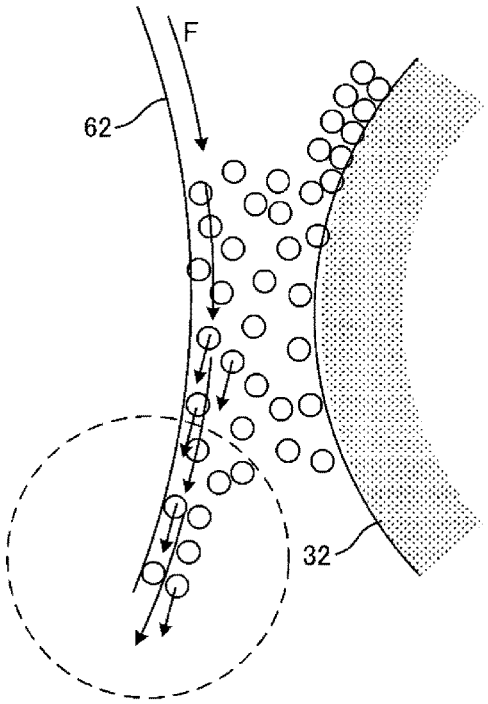
Figure 9A:
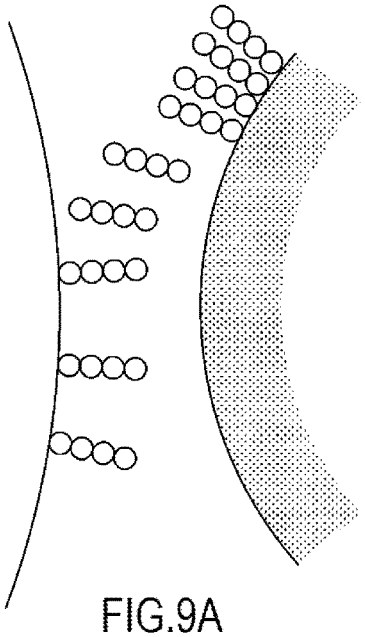
FIGS. 9A and 9B are diagrams for explaining conventional jumping development.
Figure 9B:
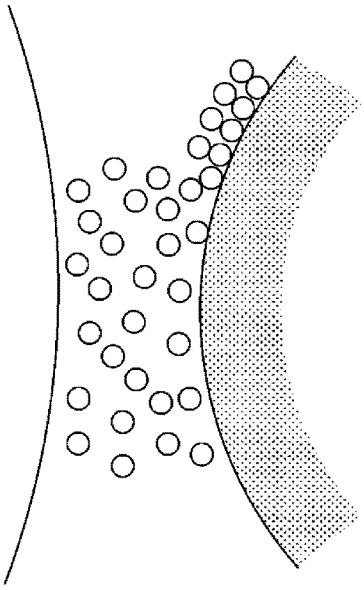
Figure 10A:
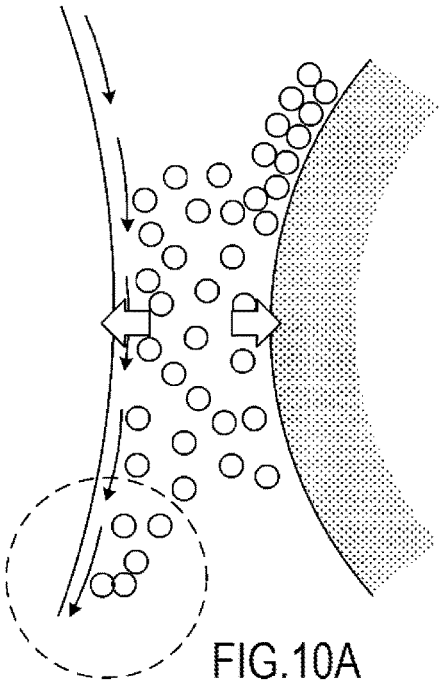
FIGS. 10A and 10B are diagrams for explaining the cause of fogging in jumping development.
Figure 10B:
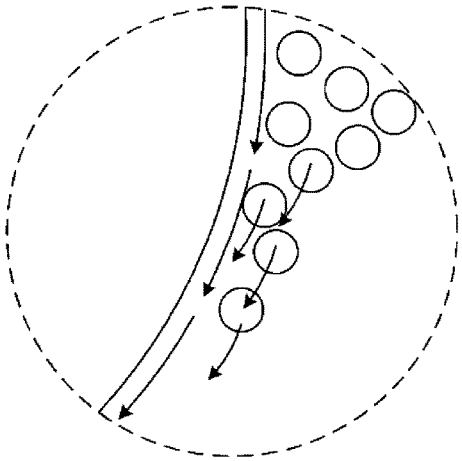

The toner consumption amount can be reduced by using the above toner, but in recent years it has become difficult to reduce fogging when attempting to accommodate higher process speeds. The underlying causes for this are explained in FIGS. 8A and 8B. FIGS. 8A and 8B are diagrams illustrating air flow between the photoconductor drum 62 and the developing roller 32. As illustrated in FIG. 8A, flow of air (air flow F) arises as the air around the periphery of the rotating photoconductor drum 62, the developing roller 32 and so forth, follows the rotation of these rotating bodies. As the process speed is increased, the rotational speed of the photoconductor drum 62, the developing roller 32 and so forth increases as well. As illustrated in FIG. 8B the individual toner particles of small mass move then readily along the rotation direction of the rotating bodies, due to the influence of the air flow F, along the rotation direction, that is generated around the rotating bodies. The influence of air flow is felt yet more readily in a configuration where the surfaces of the photoconductor drum 62 and the developing roller 32 move in the same direction, in a region where the electrostatic latent image is developed, as in the present example.

In particular, toner moving downstream in the rotation direction of the photoconductor drum 62 on account of the air flow F, at the region surrounded by the dotted line of FIG. 8B, moves away from the developing roller 32, and accordingly is less readily affected by magnetic forces, developing bias and so forth. In some instances, therefore, the toner that should return onto the developing roller 32 upon a repeat of the reciprocating motion by jumping development, fails to return to the developing roller 32 due to the above reason. In such a case toner is transferred to the paper in the form of fogging.

TABLE 1

| Toner | Number-average particle size (μm) | Average circularity | Residual magnetization σr (Am$^2$/kg) | σr × D | Toner state of the developing region | Toner consumption amount (mg/print) | Fogging |
|---|---|---|---|---|---|---|---|
| ① | 5 | 0.982 | 1.4 | 7 | ○ | 21.1 | ○ |
| ② | 4 | 0.981 | 1.09 | 4.4 | ○ | 23.2 | ○ |
| ③ | 3.4 | 0.982 | 0.92 | 3.1 | ○ | 30.8 | x |
| ④ | 4.7 | 0.981 | 3.58 | 16.8 | ○ | 33.6 | ○ |
| ⑤ | 7.3 | 0.98 | 2.27 | 16.6 | ○ | 36.8 | ○ |
| ⑥ | 8.2 | 0.98 | 3.56 | 29.2 | ○ | 42.3 | ○ |
| ⑦ | 8.5 | 0.981 | 4.54 | 38.6 | x | 51.6 | ○ |
| ⑧ | 4.8 | 0.948 | 3.4 | 16.3 | x | 48.2 | ○ |

The results explained thus far and Table 1 reveal that development in a cloud state, and not in a magnetic brush state, is possible if the average circularity is 0.950 or higher, and the product of the residual magnetization σr at a magnetic field of 79.6 kA/m and the number-average particle size (D) is $3.2 \leq \sigma r \times D \leq 38.0$. In Table 1, this state is referred to as good (○) in the "toner state of the developing region". In the present example the position of the magnetic pole is set to be on the downstream side. Specifically, the position of the magnetic pole is set further downstream, in the rotation direction, than a line that joins the central axis of rotation of the photoconductor drum 62 and the central The magnetic force of the magnetic pole S1 can be conceivably increased in order to draw the fogging toner back towards the developing roller 32. However, the toner is brought to a cloud state through weakening of the magnetic constraining force that acts on the toner. When the magnetic force of the magnetic pole S1 is increased, therefore, the toner on the developing roller 32 forms a magnetic brush and the toner consumption amount increases. Accordingly, the magnetic force of the magnetic pole S1 cannot be increased herein. It has been thus difficult to reduce fogging upon increased process speed, in the above configuration that involves development in a cloud state. Table 2 illustrates a relationship between process speed and fogging. The toner used in Table 2 is toner #5 in Table 1. The image forming apparatus explained in the present example is used for image outputting. The rotational speed of the photoconductor drum 62 is modified herein.

A solid white image was output in a normal-temperature normal-humidity environment (23° C. and 60% RH), and fogging was measured using a REFLECTMETER MODEL TC-6DS by Tokyo Denshoku Co., Ltd. A green filter is used as the filter, and the fogging amount is measured as: fogging (reflectance) (%)=reflectance (%) of standard paper−reflectance (%) of solid white portion. The evaluation criterion of fogging is good (○) when fogging is lower than 2%, fair (Δ) when fogging is 2% to less than 2.5%, and poor (x) when fogging is 2.5% or higher. The magnetic pole S1 is disposed at a position opposing the photoconductor drum 62. The peak position of the magnetic flux density of the magnetic pole S1 opposes the central axis of rotation of the photoconductor drum 62.

TABLE 2

| Drum rotational speed (mm/sec) | Fogging |
|---|---|
| 100 | ○ |
| 155 | ○ |
| 200 | ○ |
| 240 | Δ |
| 250 | x |
| 300 | x |
| 400 | x |

Figure 1:
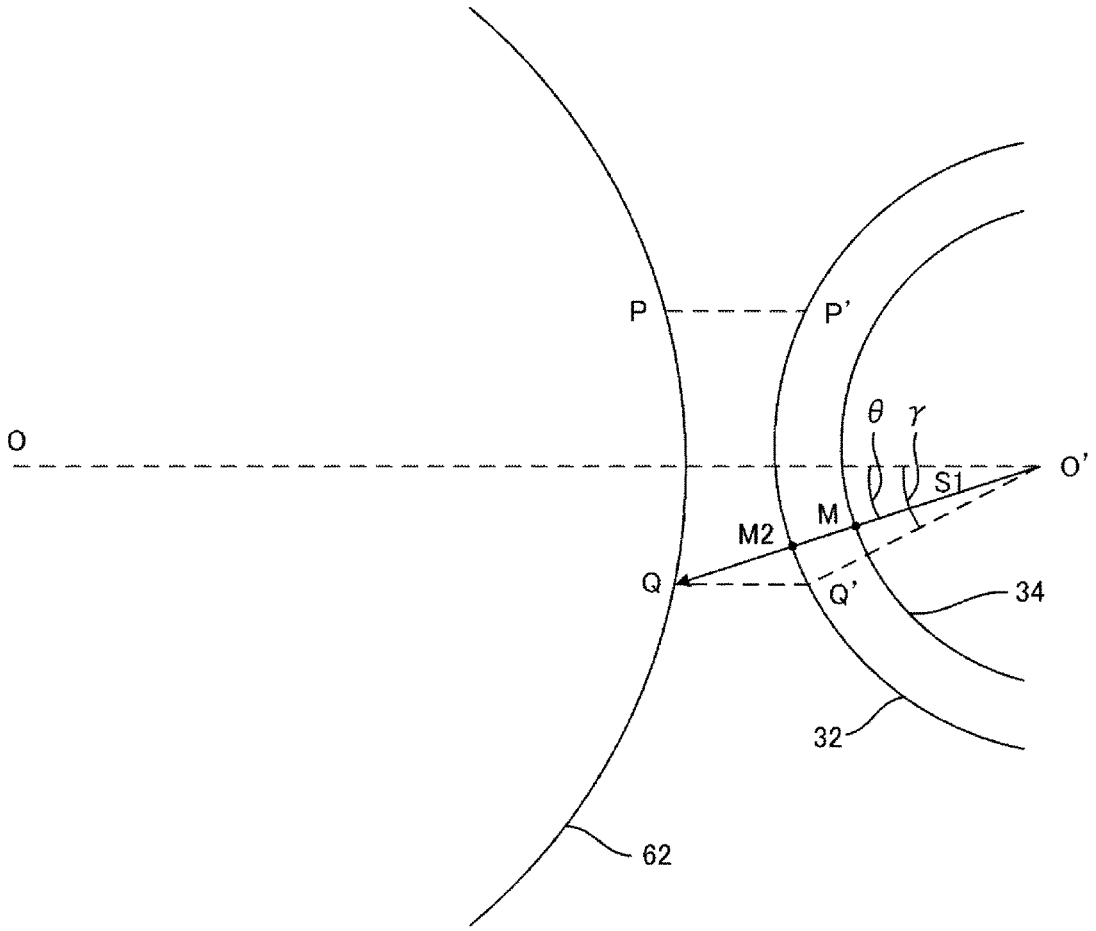
FIG. 1 is a diagram illustrating the spacing between a photoconductor drum and a developing roller according to Example 1.

Such being the case, in the present example the peak position of the magnetic flux density of the magnetic pole S1 is set to lie downstream in the rotation direction of the developing roller 32 in order to reduce fogging while maintaining as-is the toner consumption amount, in a case of increased process speed in a jumping development scheme. Specifically, the peak position of the magnetic flux density of the magnetic pole S1 is set further downstream, in the rotation direction, than a line joining the central axis of rotation of the photoconductor drum 62 and the central axis of rotation of the developing roller 32. As a result, it becomes possible to increase the magnetic force on the downstream side of the rotation direction of the developing roller 32. An explanation follows next, with reference to FIG. 1, on the position of the magnetic pole S1 on the basis of the developing region, which is a region at which the electrostatic latent image is developed by cloud-state toner, since the cause of fogging that occurs through an increase in process speed lies downstream of the developing region. FIG. 1 is a diagram illustrating the spacing between the photoconductor drum 62 and the developing roller 32 according to Example 1.

<Developing Region>

Herein there is considered a cross-section of the developing roller 32 and of the photoconductor drum 62 as viewed in the direction of the central axis of rotation O' (rotation axis direction) of the developing roller 32. The term developing region denotes herein a region on the photoconductor drum 62 (corresponding to the image carrier) at which an electrostatic latent image is developed, when toner is electrically caused to fly between the photoconductor drum 62 and the developing roller 32 in a state where the photoconductor drum 62 and the developing roller 32 are not rotating. The developing region is the region at which the electrostatic latent image is developed in a case where the electrostatic latent image is formed over the entire peripheral surface of the photoconductor drum 62. In a case where the electrostatic latent image is formed over the entire peripheral surface of the photoconductor drum 62 it is difficult to define specifically the developing region during rotational driving of the photoconductor drum 62. Accordingly, it is necessary to apply DC voltage to the developing roller 32 in such a manner that a potential difference arises between the developing roller 32 and the electrostatic latent image on the photoconductor drum 62, with driving of the photoconductor drum 62 in a stopped state. In the present example developing bias in the form of DC bias of −300 V is applied for 5 seconds to the developing roller 32, in a state where the potential of the photoconductor drum 62 is 0 V. In FIG. 1 the developing region is the region between P and Q in the circumferential surface of the photoconductor drum 62.

Herein position P is the position of the upstream end portion of the developing region of the photoconductor drum 62, in the rotation direction, and position Q is the position of the downstream end portion of the developing region of the photoconductor drum 62, in the rotation direction (corresponding to the downstream end portion in the rotation direction). Further, position P' is a position on the developing roller 32 opposing position P, in the direction in which there extends line segment OO' (first line segment) in FIG. 1. Similarly, position Q' is a position on the developing roller 32 opposing position Q, in the direction in which there extends line segment OO' in FIG. 1.

In FIG. 1, the region on the developing roller 32 corresponding to the developing region on the photoconductor drum 62 constitutes an opposing region (second region). As illustrated in FIG. 1, the opposing region is a region between position P' and position Q' on the outer peripheral surface of the developing roller 32. Specifically, the opposing region is a region on the developing roller 32 resulting from projecting the developing region in the direction from the central axis of rotation O of the photoconductor drum 62 towards the central axis of rotation O' of the developing roller 32. That is, the upstream end portion of the opposing region of the developing roller 32, in the rotation direction, is position P', and the downstream end portion of the opposing region of the developing roller 32, in the rotation direction, is position Q'. Ordinarily toner flies in the region demarcated by position P, position P', position Q and position Q'. Toner that gives rise to fogging flies also within this region. When the process speed is raised, however, in some instances toner moves downstream of the developing region, in the rotation direction of the photoconductor drum 62, due to the influence of the air flow F, as explained above. As a result, such flown toner fails to return onto the developing roller 32, and is made visible on paper in the form of fogging.

<Angle Range of the Magnetic Pole S1>

The arrangement of the magnetic pole S1 will be explained next with reference to FIG. 1. FIG. 1 is a diagram illustrating the spacing between the photoconductor drum 62 and the developing roller 32 according to Example 1. In Example 1, the central axis of rotation of the photoconductor drum 62 and the central axis of rotation of the developing roller 32 are parallel to each other. Herein line segment OO' is the line segment that joins the central axis of rotation O of the photoconductor drum 62 and the central axis of rotation O' of the developing roller 32. The central axis of rotation O' of the developing roller 32 coincides with the central axis of the magnet roller 34 that is enclosed by the developing roller 32. Herein position P is the position of the upstream end portion of the developing region of the photoconductor drum 62, in the rotation direction, and position Q is the position of the downstream end portion of the developing region of the photoconductor drum 62, in the rotation direction.

Further, position P' denotes a position on the developing roller 32 opposing position P, and position Q' denotes a position on the developing roller 32 opposing position Q, in the direction in which line segment OO' extends. Further, line segment M2O' (second line segment) is the line segment that joins position M2, which is a position on the surface of the developing roller 32 at which the magnetic flux density of the magnetic pole S1 is maximal, and the central axis of rotation O' of the developing roller 32. Line segment Q'O' (third line segment) is the line segment that joins the central axis of rotation O' of the developing roller 32 and position Q' on the developing roller 32. Further, angle θ (°) (first angle) is the angle formed by line segment OO' and line segment M2O', in the rotation direction of the developing roller 32.

Conventionally, the above angle obeyed angle θ=0°, since the position (peak position of magnetic flux density) on the surface of the developing roller 32 at which the magnetic flux density of the magnetic pole S1 is maximal opposed the photoconductor drum 62. The further line segment M2O' rotates downstream in the rotation direction of the developing roller 32, the greater angle θ becomes. The reason for the exacerbated fogging caused by an increase in process speed lies in the movement of toner downstream of the developing region, in the rotation direction, of the photoconductor drum 62. Accordingly, the more angle θ is increased, the greater the degree to which there can be reduced adhesion, onto the photoconductor drum 62, of toner having moved downstream of the developing region, in the rotation direction, of the photoconductor drum 62.

In a case where the straight line that joins the central axis of rotation O' of the developing roller 32 and position M2 runs through position Q, it becomes possible to reduce movement of toner downstream of the developing region, in the rotation direction, of the photoconductor drum 62, and the occurrence of fogging can be reduce to the greatest extent. Herein position M is the position, on the surface of the magnet roller 34, that is run through by line segment M2O'. Although fogging can be reduced also when angle θ is set to be large, the magnetic constraining force on toner within the developing region becomes weaker when the peak position of magnetic flux density of the magnetic pole S1 deviates from the developing region. As a result, a large amount of fogging-causing toner becomes deposited in the developing region, and the state of fogging worsens abruptly.

In the present example, accordingly, angle θ is set to lie in the range 0<θ≤γ, where angle γ (second angle) is the angle formed between line segment OO' and line segment O'Q' in the rotation direction of the developing roller 32. As a result, fogging can be reduced in the present example even upon increased process speed. As described above, fogging is reduced to the greatest extent in a case where angle θ is identical to the angle formed by line segment O'Q (fourth line segment) and line segment OO'. In the present example, specifically, angle θ is set to 0<θ≤16°, since angle γ=16°. Preferably, angle θ is set to lie in the range 4°≤θ≤16° (4° to 16°). The present example is designed so that angle θ=8°. The second angle corresponds to a maximum value of the position at which a straight line from the axis line of the developing roller intersects the developing region, such that at an angle larger than the second angle, the straight line no longer intersects the developing region.

<Verification Experiment of the Effect of the Magnetic Pole S1>

The relationship between the peripheral speed of the photoconductor drum 62, angle θ and the occurrence of fogging will be explained next with reference to Table 3. The toner used in the experiment results given in Table 3 is toner #5 in Tables 1 and 2. The image forming apparatus 1 according to the present example is used for image outputting, and the peripheral speed of the photoconductor drum 62 and angle θ are modified as appropriate.

A solid white image is output in a normal-temperature normal-humidity environment (23° C. and 60% RH), and fogging is measured using a REFLECTMETER MODEL TC-6DS by Tokyo Denshoku Co., Ltd. A green filter is used as the filter, and the fogging amount is measured as: fogging (reflectance) (%)=reflectance (%) of standard paper−reflectance (%) of solid white portion. Fogging lower than 2% is rated as good (○), since fogging cannot be visually perceived in actuality, and fair (Δ) if fogging is equal to or higher than 2.0% and lower than 2.5%, since at that level some fogging can be perceived. Fogging of 2.5% or higher is rated as poor (x), since in that case fogging can be perceived distinctly.

TABLE 3

| Drum rotational speed | Angle of magnetic pole S1 and fogging on paper | | | | | | | | |
|---|---|---|---|---|---|---|---|---|---|
| (mm/sec) | θ = 0° | θ = 3° | θ = 4° | θ = 5° | θ = 10° | θ = 15° | θ = 16° | θ = 17° | θ = 20° |
| 100 | ○ | ○ | ○ | ○ | ○ | ○ | ○ | Δ | x |
| 155 | ○ | ○ | ○ | ○ | ○ | ○ | ○ | Δ | x |
| 200 | ○ | ○ | ○ | ○ | ○ | ○ | ○ | Δ | x |
| 240 | Δ | Δ | ○ | ○ | ○ | ○ | ○ | Δ | x |
| 250 | x | Δ | ○ | ○ | ○ | ○ | ○ | Δ | x |
| 300 | x | x | Δ | ○ | ○ | ○ | ○ | Δ | x |
| 400 | x | x | x | x | Δ | ○ | ○ | Δ | x |

A Table 3 reveals, fogging on paper increases with increasing rotational speed of the photoconductor drum 62, in a case where the electrostatic latent image is developed using cloud-state toner. Fogging on paper can be improved by increasing angle θ. When angle θ is increased excessively, contrariwise, fogging is exacerbated. As Table 3 indicates, fogging tends to worsen at θ=0° when the peripheral speed of the photoconductor drum 62 is 240 mm/sec or higher. Therefore, angle θ must be increased in a case where the peripheral speed of the photoconductor drum 62 is 240 mm/sec or higher. In the present example, the process speed is 250 mm/sec, and hence fogging can be reduced by setting angle θ to 0<θ≤16° (more preferably, 4°≤θ≤16°.

As explained in the above, in Example 1, among the angles in the rotation direction of the developing roller 32, thus, the angle formed by line segment OO' and line segment M2O' is larger than 0° and equal to or smaller than the angle formed by line segment OO' and the line segment Q'O'. As a result, fogging can be reduced in a case where an electrostatic latent image is developed by relying on a jumping development scheme using cloud-state toner.

In Example 1, moreover, the toner consumption amount at edge portions of the electrostatic latent image can be reduced by bringing toner to a cloud state.

Example 2

<Configuration of the Image Forming Apparatus>

Figure 12:
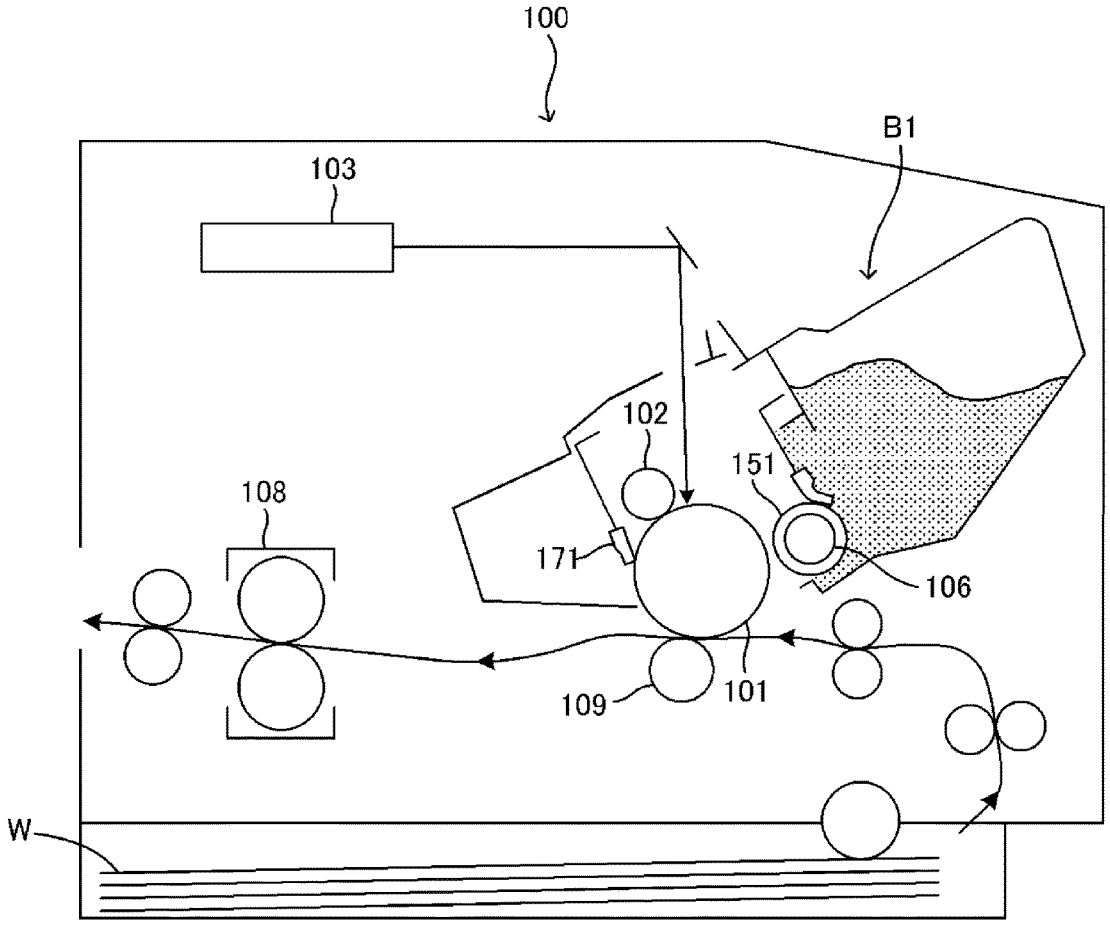
FIG. 12 is a schematic cross-sectional diagram illustrating an image forming apparatus according to Example 2.

FIG. 12 is a schematic cross-sectional diagram illustrating an image forming apparatus 100 according to Example 2. The image formation operation in the image forming apparatus 100 will be explained next. Upon start of the image formation operation, a photoconductor drum 101 is rotatably driven in the arrow direction in FIG. 12 by a photoconductor driving motor (not shown).

Negative voltage is applied, at a predetermined timing, from a charging power source (not shown), to a charging roller 102, as a charging device that charges the surface of the photoconductor drum 101. The surface of the photoconductor drum 101 is negative-charged uniformly by the charging roller 102. A laser exposure unit 103 as an exposure device that exposes the charged photoconductor drum 101 exposes the photoconductor drum 101 by way of a laser beam, in accordance with image data, to form as a result an electrostatic latent image on the photoconductor drum 101.

A developing apparatus 104, as a developing device, causes the electrostatic latent image on the photoconductor drum 101 to be made visible in the form of a toner image, through application of developing bias from a developing bias power source (not shown) to a developing sleeve 151 as a developer carrier. The toner image having been made visible on the photoconductor drum 101 is conveyed to a portion of contact of the photoconductor drum 101 and a transfer roller 109, and is transferred to the sheet material W that has been transported in concert with the above timing. Transfer bias is applied to the transfer roller 109 by a power source, not shown. The sheet material W having had the toner image transferred thereonto is heated and pressed by a fixing device 108. The toner image becomes fixed as a result onto the sheet material W. An image becomes thus formed on the sheet material W as a result of the above steps.

<Developing Apparatus>

In the developing apparatus 104 being the developing means according to the present example, a developing sleeve 151 in which a magnetic one-component toner is used as the toner is disposed at a predetermined spacing of the photoconductor drum 101. In the present example, the developing apparatus 104 reverse-develops the electrostatic latent image on the photoconductor drum 101 in a state where the developing sleeve 151 and the photoconductor drum 101 are not in contact. That is, the developing apparatus 104 is a developing apparatus that relies on a magnetic one-component jumping development scheme and on a reverse developing scheme. In the present example, a gap (S-D gap) between the developing sleeve 151 and the photoconductor drum 101 is maintained by the developing roller that is disposed at both end portions of the developing sleeve 151. During development, superimposed DC-AC voltage is applied, as developing bias, across the developing sleeve 151 and the photoconductor drum 101.

Figure 13:
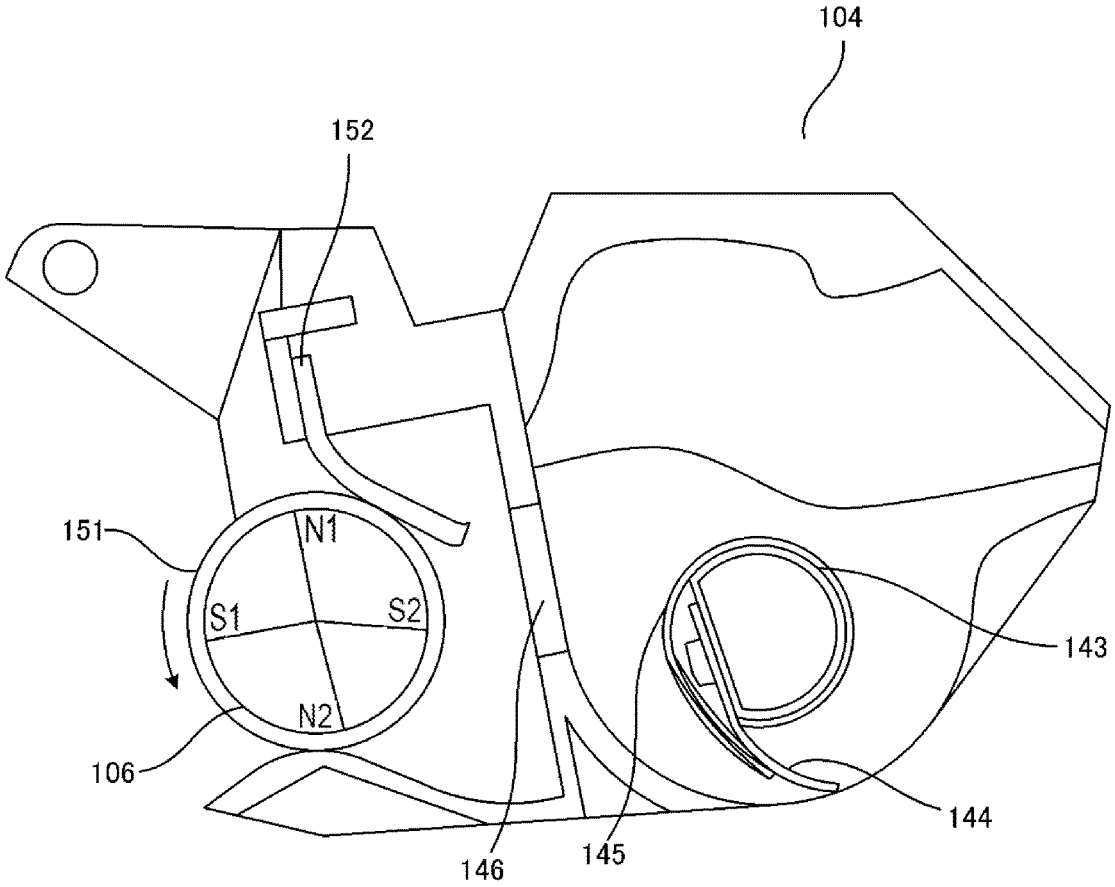
FIG. 13 is a schematic cross-sectional diagram of a developing apparatus according to Example 2.

The developing apparatus 104 according to the present example will be explained next with reference to FIG. 13. FIG. 13 is a schematic cross-sectional diagram of the developing apparatus 104 according to Example 2. A process cartridge B1 of FIG. 12 is provided in the developing apparatus 104. The process cartridge B1 can be attached/detached to/from the apparatus body of the image forming apparatus 100. In the developing apparatus 104, the developing sleeve 151, which is a non-magnetic developing sleeve formed out of a pipe of aluminum, stainless steel or the like, is rotatably driven in the arrow direction of FIG. 13. A magnet roller 106 as a magnet having a plurality of magnetic poles N-S disposed alternately, is fixed within the developing sleeve 151. The surface of the developing sleeve 151 is worked to a roughness such that the desired amount of toner can be transported thereon.

A transport member 143 is disposed inside the developing apparatus 104. The transport member 143 has a toner stirring sheet 144. The toner stirring sheet 144 stirs and transports toner within the developing apparatus 104 through rotation of the transport member 143. A developing blade 152 as a developer regulating member formed of an elastic body, above the developing sleeve 151, abuts the latter at a predetermined pressure. Inside a container in which the toner is accommodated within the developing apparatus 104, the amount of toner attracted to the developing sleeve 151 by magnetic forces is regulated by the developing blade 152, and the toner is imparted by the latter with appropriate charge. The toner on the developing sleeve 151 (corresponding to toner on a resin layer), is transported to a developing region on the photoconductor drum 101. The definition of the developing region in Example 2 is identical to the definition of the developing region according to Example 1. The toner that has not been used for developing is returned to the container accompanying the rotation of the developing sleeve 151.

<Magnet Roller>

The magnet roller 106 disposed inside the developing sleeve 151 will be explained next in detail. The magnet roller 106 according to the present example is disposed inside the developing sleeve 151, in such a manner that a magnetic pole S101 in the magnet roller 106 opposes the photoconductor drum 101. The magnet roller 106, which is a magnet having four magnetic poles (magnetic pole N101, magnetic pole N102, magnetic pole S101 and magnetic pole S102) in the interior, is a resin magnet in which a magnetic body powder is bonded by way of a synthetic resin binder such as nylon or the like. The toner is attracted to the surface of the developing sleeve 151 and is held thereon by the magnetic force of the magnetic pole S102 of the magnet roller 106. Appropriate charge is imparted to the toner through triboelectric charging by the developing blade 152. Thereafter, the toner is transported to the vicinity of the magnetic pole S101 in the magnet roller 106, accompanying the rotation of the developing sleeve 151.

<Developing Sleeve>

In the present example the developing sleeve 151 is formed by providing a resin layer on a non-magnetic conductor (base member). The base member may be for instance a tubular member, a cylindrical member or a belt-like member. Materials that are used in the base member include, for instance, non-magnetic metals or alloys such as aluminum, stainless steel and brass. The base member can be coated with the resin layer for instance through dispersion and mixing, in a solvent, of the various components that are used in the resin layer, and painting of the base member with the resulting product. The resin layer can also be formed through drying and solidification, or curing, of the applied resin. Known dispersion equipment using beads, for instance a sand mill, a paint shaker, a dyno-mill, a pearl mill or the like can be used in order to disperse and mix the various components in the coating solution. A known method such as dipping, spraying, roll coating or the like can be resorted to as the coating method.

In a detailed explanation, the resin layer is obtained through by curing of a coating material composition containing (A) through (E) below:

(A) thermosetting resin as the binder resin;

(B) alcohol having 1 to 4 carbon atoms as the solvent;

(C) resin having units represented by Formula (R);

(D) graphitized carbon black having an interplanar spacing of the graphite (002) plane in the range of 0.3370 nm to 0.3450 nm, as measured by X-ray diffraction;

(E) acidic carbon black having pH of 5.0 or lower.

[C1]

(R)

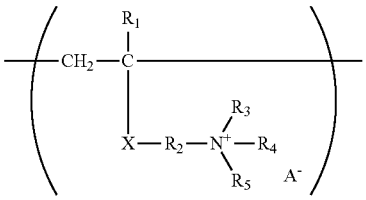

In Formula (R), R1 represents a hydrogen atom or a methyl group, and R2 represents an alkylene group having 1 to 4 carbon atoms. One, two or more selected from among R3, R4 and R5 represents an alkyl group having 4 to 18 carbon atoms, and the other groups represent an alkyl group having 1 to 3 carbon atoms. Further, X is any one of —COO—, —CONH— and —C6H4-, and A- represents an anion.

The volume resistivity of the resin layer of the developing sleeve 151 lies preferably in the range of $10^{-1}$ Ω·cm to $10^{2}$ Ω·cm. By prescribing the volume resistivity of the resin layer of the developing sleeve 151 to lie within the above range it becomes possible to suppress fixing of the toner to the developing sleeve caused by charge-up. Problems that occur during triboelectric charging of the toner at the surface of the developing sleeve 151, and which arise due to charge-up of the toner, can likewise be reduced.

In the present example coarse particles for forming irregularities can be added to the conductive resin coating layer in order to uniformly preserve the surface roughness of the conductive resin coating layer. The coarse particles are not particularly limited, and specific examples thereof include, for instance, rubber particles such as EPDM, NBR, SBR, CR or silicone rubber, as well as polystyrene, polyolefins, polyvinyl chloride, polyurethane, polyesters and the like. Further examples include, for instance, elastomer particles of polyamide-based thermoplastic elastomers (TPEs), as well as PMMA, urethane resins, fluororesins, silicone resins, phenolic resins, naphthalene resins, furan resins and the like. Yet further examples include resin particles of xylene resins, divinylbenzene polymers, styrene-divinylbenzene copolymers and polyacrylonitrile resins, and also alumina, zinc oxide, titanium oxide and the like. Further examples include oxide particles such as tin oxide, conductive particles such as carbonized particles, and resin particles having been subjected to a conductive treatment, among others; for instance, coarse particles resulting from making an organic compound such as an imidazole compound into particulate form. As a yardstick, the arithmetic average roughness Ra (JIS B0601-2001) of the surface of the developing sleeve lies in the range of 0.4 μm to 3.0 μm.

Figure 14A:
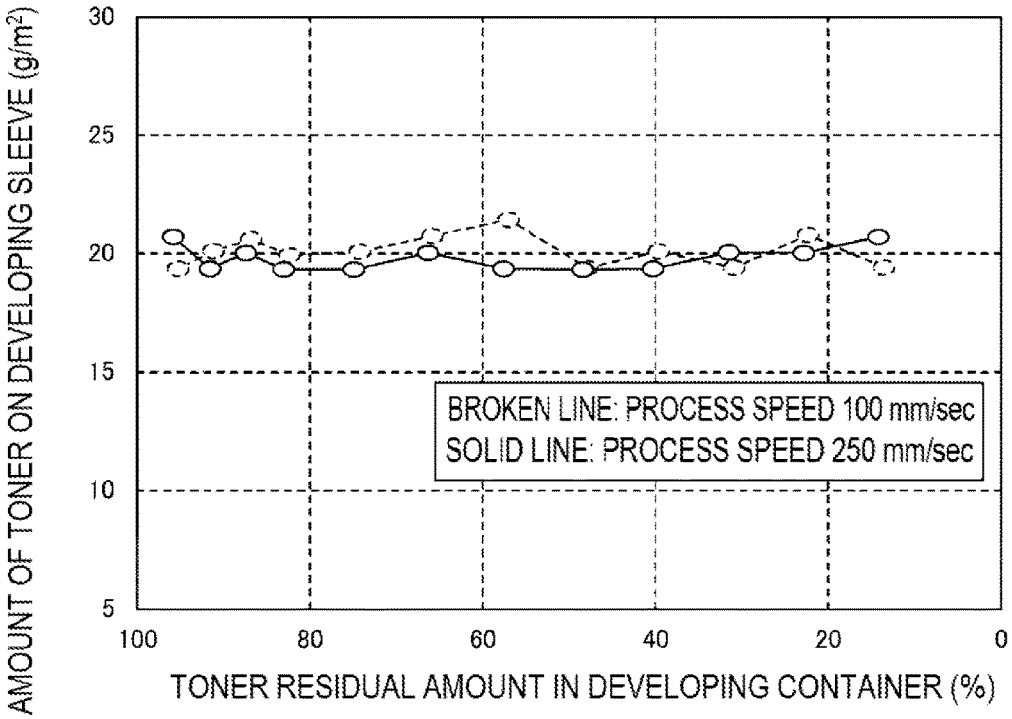
FIGS. 14A and 14B are diagrams illustrating charge amount of toner and toner amount on a developing sleeve.
Figure 14B:
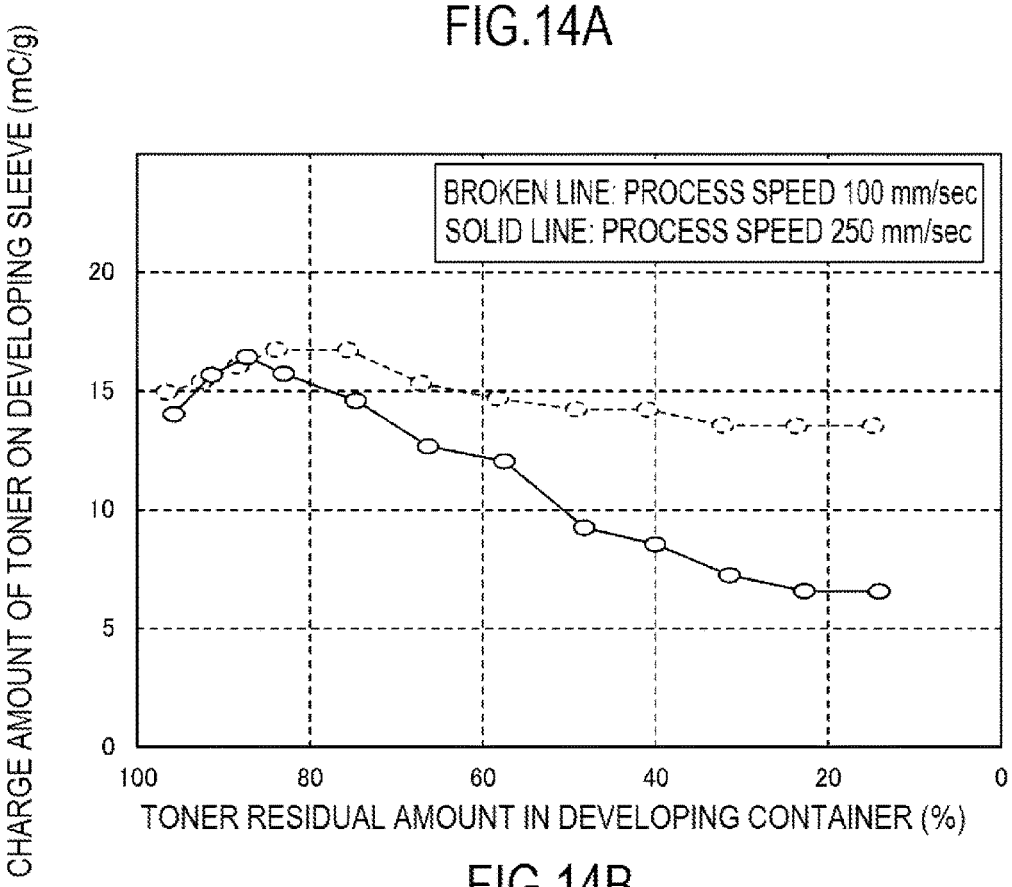

In the present example uniform lubricity is imparted to the surface of the developing sleeve 151 by combining graphitized carbon black and acidic carbon black. Accordingly, it becomes possible to charge the toner uniformly, even while reducing the abutting pressure of the developing blade 152 on the developing sleeve 151. Further, it becomes possible to reduce changes in the surface roughness of the developing sleeve 151 derived from rubbing with the developing blade 152. FIGS. 14A and 14B are diagrams illustrating charge amount of toner and toner amount on the developing sleeve 151. As illustrated in FIG. 14A, the toner amount on the developing sleeve 151 can be maintained even when the toner residual amount decreases through prolonged use of the image forming apparatus 100. As a result, it becomes possible to maintain the density of the images that are formed on the sheet material W.

<Charge State of the Toner>

As is widely known, for instance inorganic fine powders such as magnesium oxide, zinc oxide, aluminum oxide, titanium oxide, lead oxide and other oxides, as well as sulfides, nitrides, silica and so forth, are externally added to toner in order to stabilize the charge state of the toner. The charge state of the toner is related to the amount of the external additive.

Figure 15:
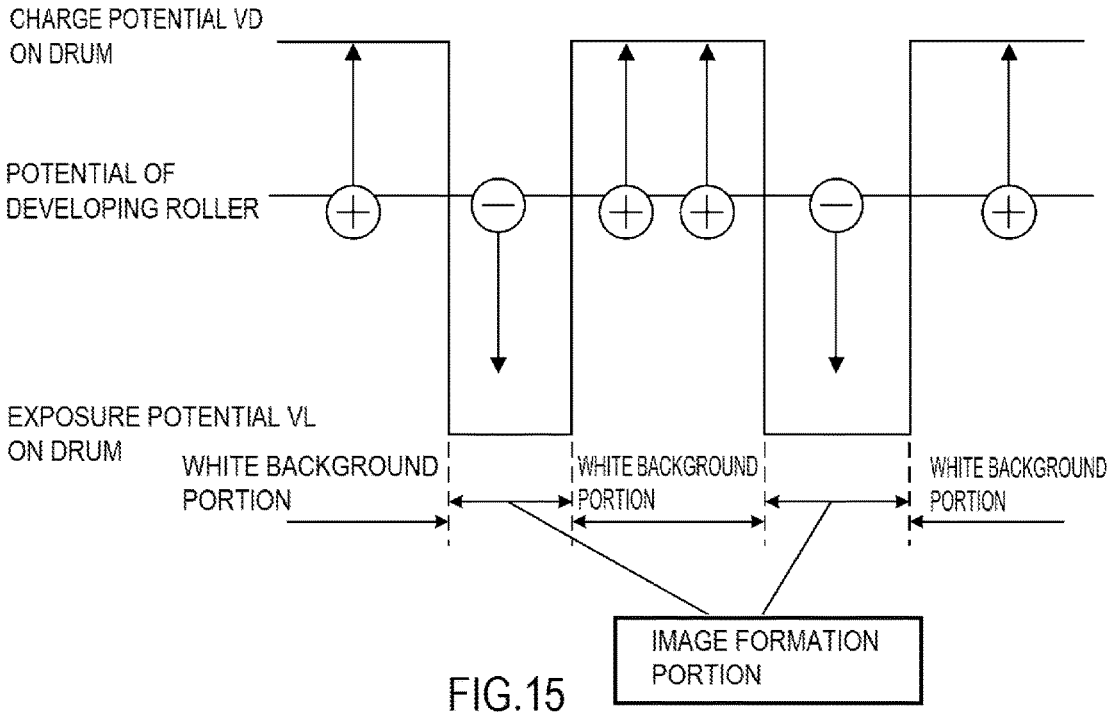
FIG. 15 is a schematic diagram illustrating a potential difference between a photoconductor drum and a developing sleeve.

As an example, an instance will be explained next in which microparticles having positive polarity are added to negative-chargeable toner. Particles of positive polarity adhere to the surface of the negative-chargeable toner; thereupon, the toner becomes charged stably to negative polarity through rubbing between the particles of positive polarity and the negative-chargeable toner. FIG. 15 is a schematic diagram illustrating a potential difference between the photoconductor drum 101 and the developing sleeve 151. A substance having positive polarity flies readily to white background portions, by virtue of the relationship of the potential difference between the photoconductor drum 101 and the developing sleeve 151, as illustrated in FIG. 15.

Figure 16:
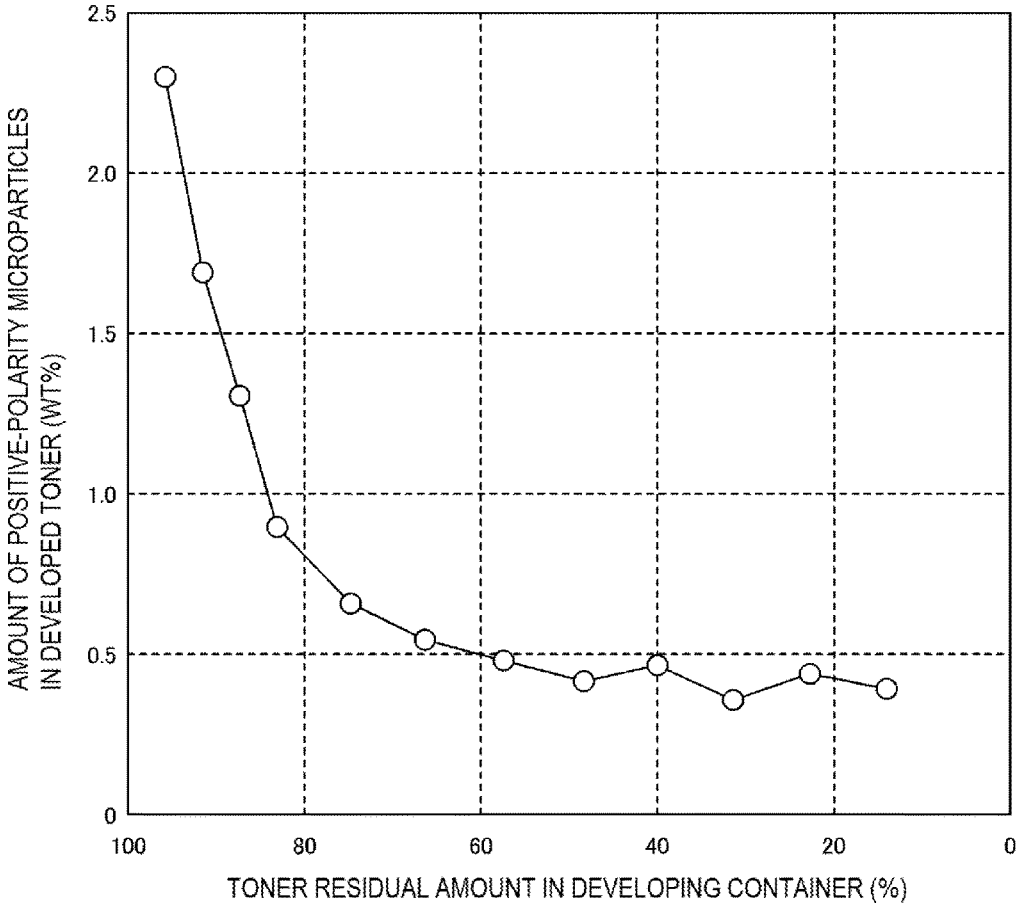
FIG. 16 illustrates the relationship between an amount of positive-polarity microparticles in the toner and toner residual amount.

FIG. 16 illustrates the relationship between the amount of positive-polarity microparticles in the toner and toner residual amount. As illustrated in FIG. 16, when the toner residual amount in the developing apparatus 104 is large, generally a large amount of toner adheres readily to white background portions, for instance in text images where white background portions are numerous, since the particles of positive polarity are present in large amounts in the toner. Thereafter, the amount of positive-polarity microparticles in the toner decreases accompanying a decrease in the toner residual amount in the developing apparatus 104. Thus, the external additive of the toner decreases, and accordingly sufficient charge fails to be imparted to the toner by the developing blade 152 in a state where the toner residual amount in the developing apparatus 104 is small (latter half of endurance output).

<Problems Derived from Speed-Up>

Figure 17:
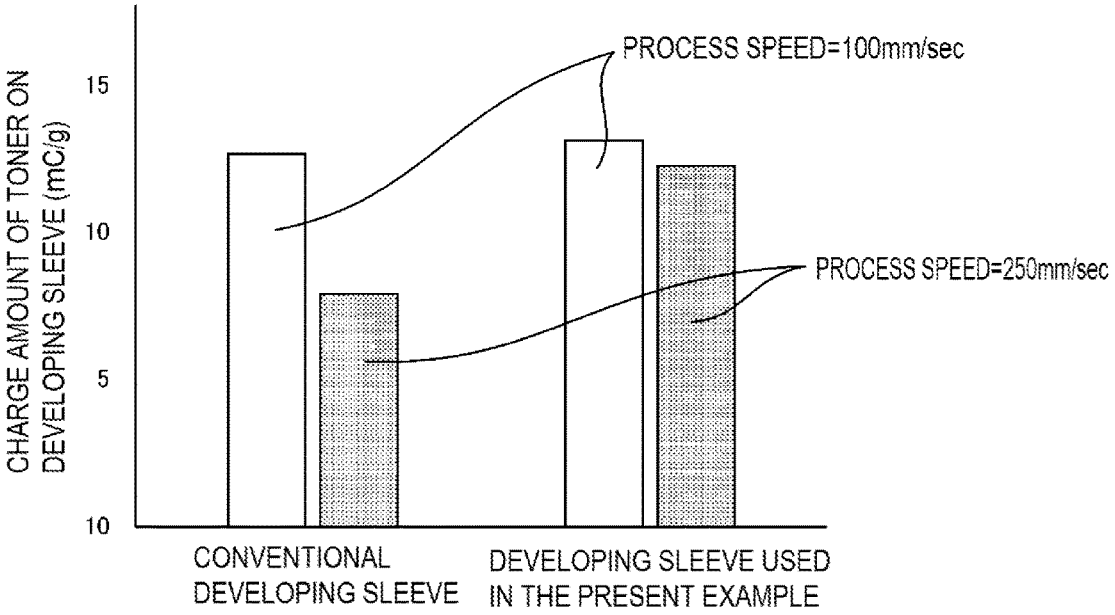
FIG. 17 is a diagram illustrating the relationship between charge amount of toner on a developing sleeve and process speed.
Figure 18:
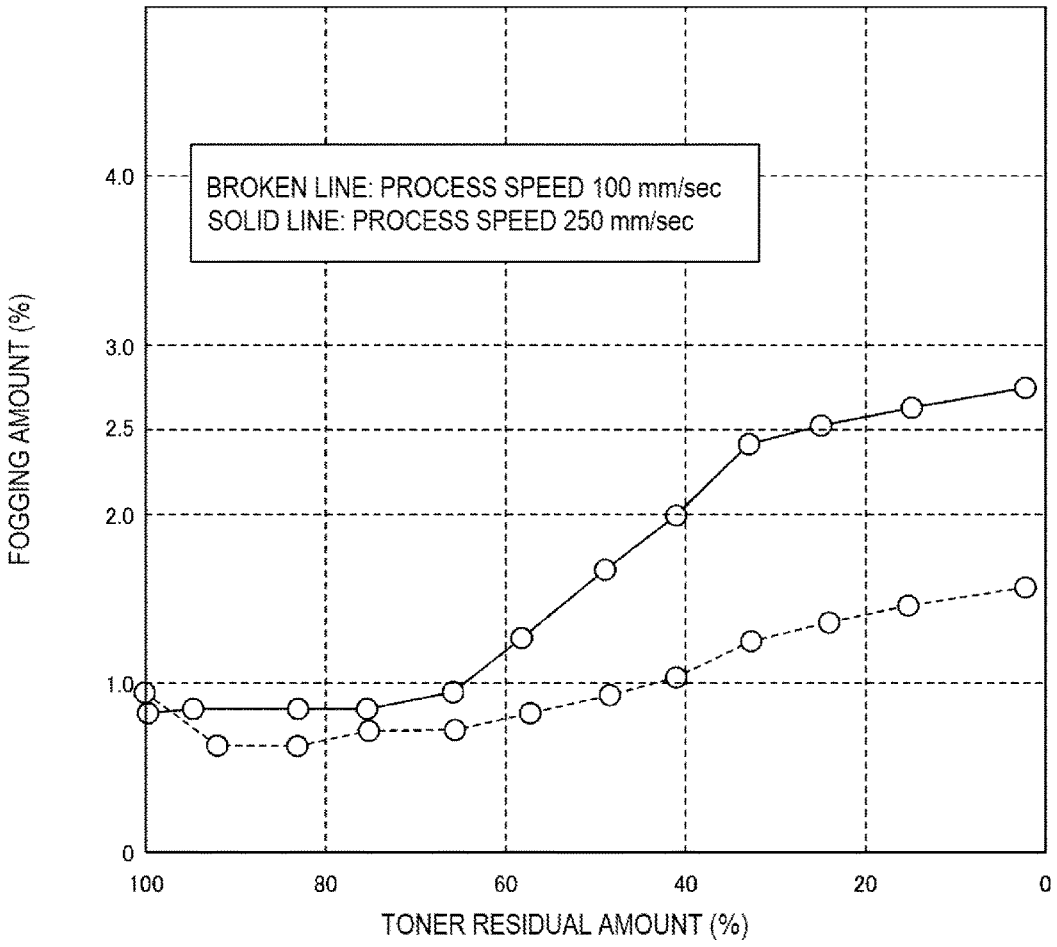
FIG. 18 is a diagram illustrating the relationship between toner residual amount and fogging amount for each process speed.
Figure 19:
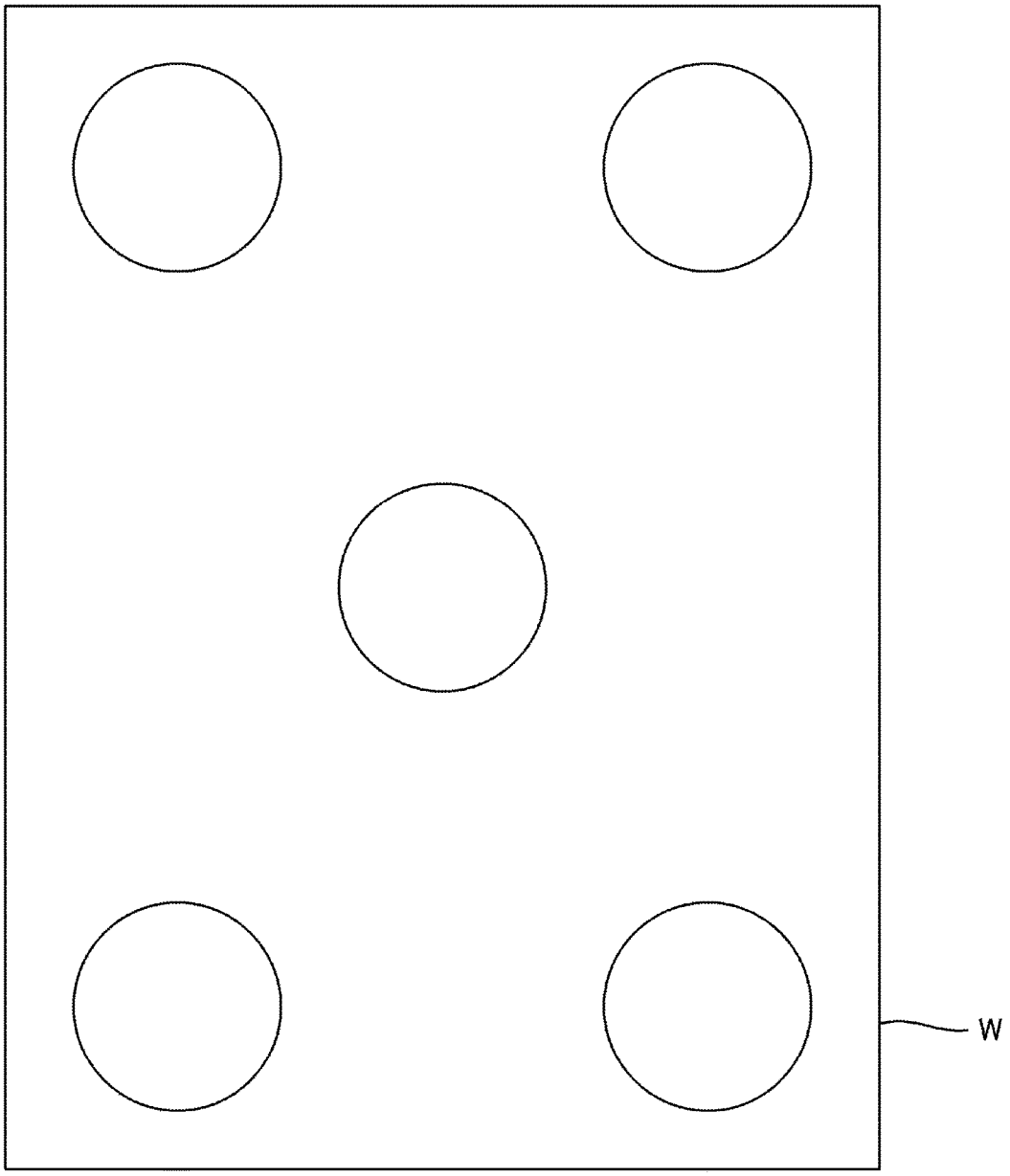
FIG. 19 is a schematic diagram illustrating a portion at which fogging is measured.

FIG. 17 is a diagram illustrating the relationship between the charge amount of toner on the developing sleeve 151 and process speed. FIG. 18 is a diagram illustrating the relationship between toner residual amount and fogging amount for each process speed. FIG. 19 is a schematic diagram illustrating a portion at which fogging is measured. When using the developing sleeve 151 according to the present example in the image forming apparatus 100 with increased process speed, the charge amount (μC/g) of toner on the developing sleeve 151 is larger than conventional instances, as illustrated in FIG. 17. That is, the toner on the developing sleeve 151 can be charged uniformly. In the case where process speed of the image forming apparatus 100 is increased in the present example, however, the charge amount (μC/g) of toner on the developing sleeve 151 decreases with decreasing toner residual amount in the developing apparatus 104, as illustrated in FIG. 14B.

In the developing sleeve 151 of the present example as well, it is therefore difficult to charge uniformly toner in which the amount of external additive has been reduced, when performing image formation over long periods of time using the image forming apparatus 100 with increased process speed. Accordingly, the amount of toner charged to a reverse polarity of the desired polarity, or the amount of uncharged toner, increases in the toner on the developing sleeve 151. Herein, as shown in FIG. 18 fogging amount (%) on paper increased with decreasing the toner residual amount (%) in the image forming apparatus 100 with increased process speed.

In order to work out the fogging amount on paper, a solid white image was output in a normal-temperature normal-humidity environment (23° C., 60% RH). The fogging amount was measured using a REFLECTMETER MODEL TC-6DS, by Tokyo Denshoku Co., Ltd., at five sites on paper, as illustrated in FIG. 19. The average value of the five sites was taken as the fogging amount on paper. The fogging amount was measured as fogging (reflectance) (%)=reflectance (%) of standard paper−reflectance (%) of solid white portion. The evaluation criterion for the fogging amount was good (○) up to 2.5%, and poor (x) 2.5% or higher.

<Developing Region>

Figure 20A:
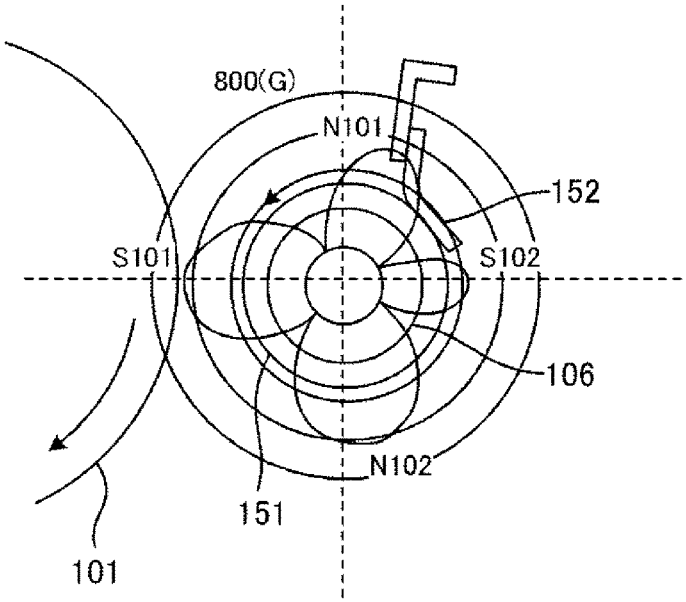
FIGS. 20A and 20B are diagrams illustrating forces acting on toner between a photoconductor drum and a developing sleeve.
Figure 20B:
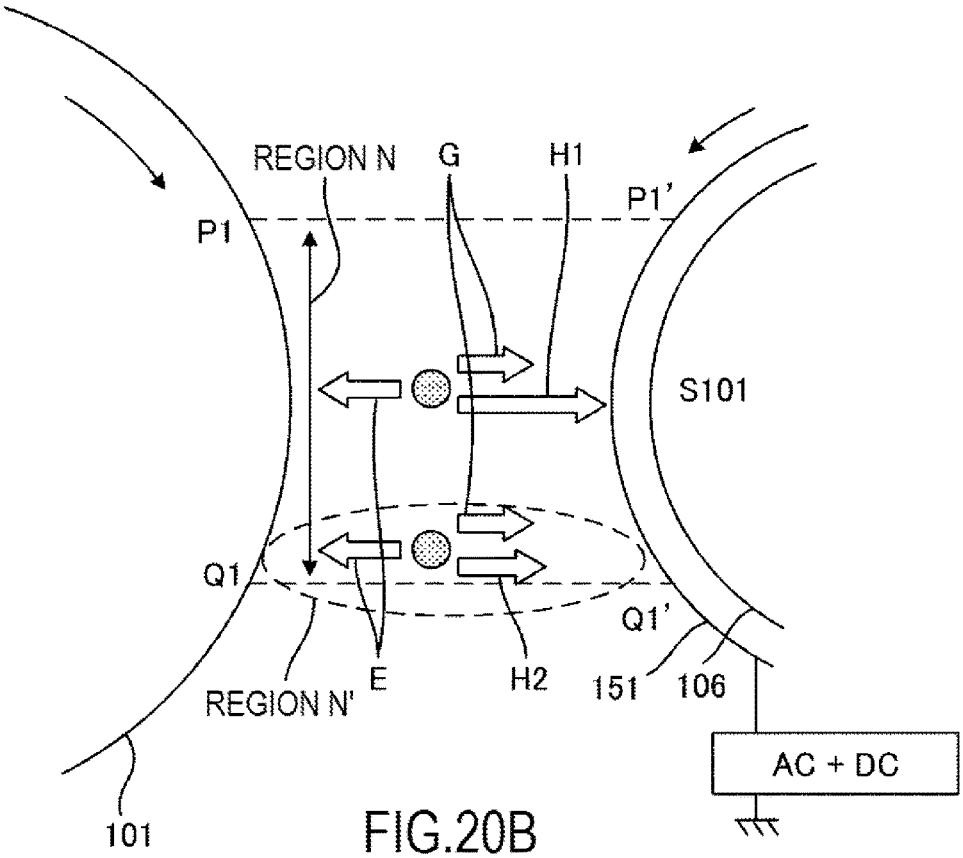

FIGS. 20A and 20B are diagrams illustrating forces acting on toner between the photoconductor drum 101 and the developing sleeve 151. Similarly to Example 1, the term developing region denotes a region at which the electrostatic latent image is developed on the photoconductor drum 101 in a case where toner is caused to fly between the photoconductor drum 101 and the developing sleeve 151 in a state where the photoconductor drum 101 and the developing sleeve 151 are not rotating. It is difficult to define specifically the developing region at a time where the photoconductor drum 101 is being rotationally driven. Accordingly, it is necessary to apply DC voltage to the developing sleeve 151 in such a manner that a potential difference arises between the developing sleeve 151 and the electrostatic latent image on the photoconductor drum 101, with driving of the photoconductor drum 101 in a stopped state. In the present example developing bias in the form of DC bias of −300 V is applied for 5 seconds to the developing sleeve 151 in a state where the potential of the photoconductor drum 101 is 0 V. In FIG. 20B the developing region is a region between P1 and Q1 in the circumferential surface of the photoconductor drum 101.

Figure 11:
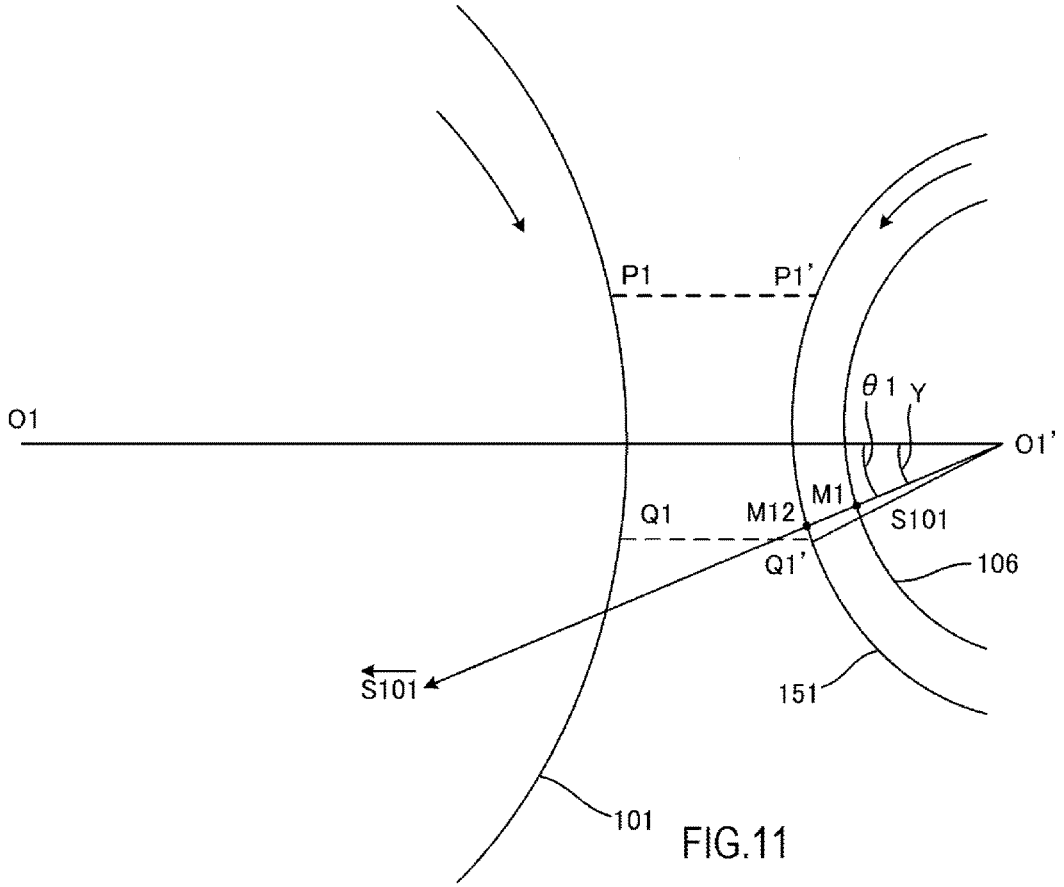
FIG. 11 is a diagram illustrating a spacing between a photoconductor drum and a developing sleeve according to Example 2.

FIG. 11 is a diagram illustrating the spacing between the photoconductor drum 101 and the developing sleeve 151 according to Example 2. Herein position P1 is the position of the upstream end portion of the developing region of the photoconductor drum 101, in the rotation direction, and position Q1 is the position of the downstream end portion of the developing region of the photoconductor drum 101, in the rotation direction. Further, position P1' is the position, on the developing sleeve 151, opposing position P1 in the direction along which there extends line segment O1O1' in FIG. 11. Further, position Q1' is the position, on the developing sleeve 151, opposing position Q1 in the direction along which there extends line segment O1O1' in FIG. 11.

In FIG. 11, as in the case of Example 1, a region of the developing sleeve 151 opposing the developing region on the photoconductor drum 101 constitutes an opposing region. In FIG. 11, the opposing region is a region between position P1' and position Q1' on the outer peripheral surface of the developing sleeve 151. That is, the upstream end portion of the opposing region of the developing sleeve 151 in the rotation direction is position P1', and the downstream end portion of the opposing region of the developing sleeve 151 in the rotation direction is position Q1'.

Ordinarily, toner flies in a region demarcated by position P1, position P1', position Q1 and position Q1'. Toner that causes fogging also flies in this region. As explained in Example 1, however, in a case where the process speed is increased the toner moves further downstream than the developing region, in the rotation direction of the photoconductor drum 101, on account of the influence of air flow between the photoconductor drum 101 and the developing sleeve 151. As a result, such flown toner fails to return onto the developing sleeve 151, and is made visible on paper in the form of fogging.

<Arrangement of Magnetic Poles in the Magnet Roller>

The toner is held on the surface of the developing sleeve 151 by the magnetic force of the S102 pole in the magnet roller 106 that is provided inside the developing sleeve 151. The developing sleeve 151 rotates in the arrow direction illustrated in FIG. 20A. Appropriate charge can be imparted to the toner through triboelectric charging of the toner by the developing blade 152. The toner having thus been charged reaches thereafter the vicinity of the magnetic pole S101 of the magnet roller 106.

As illustrated in FIG. 20B, the charged toner is acted upon by a magnetic constraining force H, generated by the magnetic force of the magnetic pole S101, and an electric force E generated by an electric field difference between the photoconductor drum 101 and the developing sleeve 151. The toner is also acted upon by an image force G generated by the charge imparted to the toner. When the relationship between the magnetic constraining force H, the electric force E and the image force G is appropriate, the toner flies from the developing sleeve 151 to the photoconductor drum 101, and the electrostatic latent image is made visible. When the charge state becomes unstable, the relationship between the three forces (magnetic constraining force H, electric force E, image force G) becomes no longer appropriate, and fogging may increase. That is because when the charge imparted to the toner is insufficient, the image force G acting on the toner becomes smaller, and the toner flies readily off the developing sleeve 151.

In a case where the peak magnetic force position of the magnetic pole S101 opposes the photoconductor drum 101, therefore, the toner flying from the developing sleeve 151 is drawn back towards the developing sleeve 151 on account of the magnetic constraining force H1, as illustrated in FIG. 20B. The toner is also drawn back towards the developing sleeve 151 on account of magnetic constraining force H2 also at a downstream region N' which is a region downstream of the developing region N in the rotation direction of the developing sleeve 151, as illustrated in FIG. 20B. However, the toner reaches the photoconductor drum 101 more readily in the downstream region N' than in the developing region N, since there holds magnetic constraining force H2<magnetic constraining force H1.

Toner having an insufficient charge state increases in the developing sleeve 151 made up of a resin layer in which there are combined graphitized carbon black and acidic carbon black of the present example, and the fogging amount increases as a result. It would be conceivable herein to increase the peak magnetic force of the magnetic pole S1 in order to strengthen magnetic force at the downstream region N', but an increase in the magnetic constraining force H in the developing region N would result in a drop in developability.

Similarly to Example 1, therefore, in the present example the magnetic pole S101 is disposed further downstream than in conventional cases, in the rotation direction of the developing sleeve 151 (FIG. 11). In Example 2, as in the case of Example 1, the central axis of rotation of the photoconductor drum 101 and the central axis of rotation of the developing sleeve 151 are parallel. As illustrated in FIG. 11, line segment O1O1' is the line segment that joins the central axis of rotation O1 of the photoconductor drum 101 and the central axis of rotation O1' of the developing sleeve 151. The central axis of rotation O1' of the developing sleeve 151 coincides with the central axis of the magnet roller 106 that is enclosed by the developing sleeve 151. As described above, position P1 is the position of the upstream end portion of the developing region of the photoconductor drum 101, in the rotation direction, and position Q1 is the position of the downstream end portion of the developing region of the photoconductor drum 101, in the rotation direction.

Further, position P1' is the position, on the developing sleeve 151, opposing position P1, and position Q1' is the position, on the developing sleeve 151, opposing position Q1, in the direction in which line segment O1O1' extends. Herein, line segment M1201' is the line segment that joins position M12, being the position, on the surface of the developing sleeve 151 at which the magnetic flux density of the magnetic pole S101 is maximal, and the central axis of rotation O1' of the developing sleeve 151. Further, line segment Q1'O1' is the line segment that joins the central axis of rotation O1' of the developing sleeve 151 and position Q1' on the developing sleeve 151. Lastly, angle θ1 (°) is the angle formed by line segment O1O1' and line segment M12O1' in the rotation direction of the developing sleeve 151.

Conventionally, the above angle obeyed angle θ1=0°, since the position at which the magnetic flux density of the magnetic pole S101 is maximal (peak position of magnetic flux density) opposed the photoconductor drum 101. The further line segment M1201' rotates downstream in the rotation direction of the developing sleeve 151, the larger angle θ1 becomes. The reason for the exacerbated fogging caused by an increase in process speed lies in the movement of toner downstream of the developing region, in the rotation direction, of the photoconductor drum 101. Accordingly, the more angle θ1 is increased, the greater the degree to which there can be reduced adhesion, onto the photoconductor drum 101, of toner having moved downstream of the developing region, in the rotation direction, of the photoconductor drum 101.

Further, in a case where a straight line that passes through position M12 and the central axis of rotation O1' of the developing sleeve 151 lies at a position at which the line passes also through position Q1, it becomes possible to reduce movement of toner downstream of the developing region, in the rotation direction, of the photoconductor drum 101. The occurrence of fogging can be reduced to the greatest extent in this case. Although fogging can be reduced also when angle θ1 is set to be large, the peak position of the magnetic flux density of the magnetic pole S101 deviates from the developing region (between P1 and Q1). As a result, the magnetic constraining force on the toner within the developing region becomes weaker. In consequence, a large amount of fogging-causing toner becomes deposited in the developing region, and the state of fogging may become worse than in the case where the peak position of the magnetic flux density lies within the developing region. In the present example, accordingly, angle θ1 is set to lie in the range 0<θ1≤Y, where angle Y is the angle formed between line segment O1O1' and line segment O1'Q1' in the rotation direction of the developing sleeve 151. As a result, fogging can be reduced in the present example even upon increased process speed. Fogging is reduced to the greatest extent in a case where angle θ1 is identical to the angle formed byline segment O1'Q1 and line segment O1O1'. Herein angle Y corresponds to a maximum value of the position at which a straight line from the axis line of the developing sleeve 151 intersects the developing region. Line segment M12O1' no longer intersects the developing region when angle θ1 is larger than angle Y.

<Verification Experiment>

The details of the developing apparatus 104 used in the present verification experiment are given next. The toner used in the present verification experiment is magnetic one-component polymerized toner produced in accordance with a polymerization method. A developing apparatus relying on a jumping development scheme is used as the developing apparatus 104. The developing sleeve 151 is formed out of a resin layer in which there are combined graphitized carbon black and acidic carbon black.

<Developing Sleeve>

Ethanol was added to a coating material for a resin layer that contained graphitized carbon black and acidic carbon black, to adjust the solids concentration to 35%. Both end portions of a cylindrical tube made up of aluminum and having an outer diameter of 10 mm were masked, the cylindrical tube was set on a rotating table and was caused to rotate, and the surface of the cylindrical tube was coated with the coating material for a resin layer, by lowering an air spray gun at a constant speed. A resin layer was formed as a result of this process. Coating was performed in a 30° C./35% RH environment, with the temperature of the coating material for a resin layer set to 28° C. in a thermostatic bath. Next, the resin layer was cured through heating of the resin layer for 30 minutes at 150° C. in hot-air drying oven, to bring the arithmetic average roughness of the developing sleeve 151 to Ra=2.50 μm.

The arithmetic average roughness (Ra) of the surface of the developing sleeve 151 was measured using Surfcorder SE-3500, by Kosaka Laboratory Ltd., on the basis of surface roughness according to JIS B0601 (2001). The measurement conditions included cutoff set to 0.8 mm, evaluation length set to 8 mm and feed rate set to 0.5 mm/sec. A total of three measurement positions (sites) were established, namely the center of the developing sleeve 151, and two positions intermediate between that central position and both coating end portions. A similar three-site measurement was performed after rotating the developing sleeve 151 by 120°. Thereafter, a similar three-site measurement was further performed after rotating the developing sleeve 151 by 120°. In the present verification experiment there were measured thus a total of nine points, and the average value of the foregoing was worked out.

The method for producing the coating material for a resin layer will be explained next.

(Production of a Coating Material for a Resin Layer)

The materials below were mixed with a coating material intermediate, to yield a coating material for a resin layer.

| | |
|---|---|
| Binder resin solids | 20 parts |
| Additive resin solids | 4 parts |

The coating material intermediate was prepared as follows.

(Production of a Coating Material Intermediate)

The following materials were mixed to yield a coating material intermediate.

| | |
|---|---|
| Binder resin solids | 20 parts |
| Graphitized carbon black | 10 parts |
| Acidic carbon black | 10 parts |
| Ethanol | 50 parts |

In the present example the graphitized carbon black, the acidic carbon black, the binder resin and the additive resin were produced as follows.

(Graphitized Carbon Black)

Carbon black (trade name: TOKABLACK #5500, by Tokai Carbon Co., Ltd.) was charged into a graphite crucible, and was graphitized by being subjected to a thermal treatment at 2500° C. in a nitrogen gas atmosphere, to yield graphitized carbon black.

(Acidic Carbon Black)

(Trade name: Special Black 4, acidity pH 3, particle size 25 nm)

(Binder Resin)

Resol-type phenolic resin (trade name: J-325, solids 60%, by DIC Corporation)

(Production of the Additive Resin Solution)

The materials below were mixed in a four-necked separable flask provided with a stirrer, a cooler, a thermometer, a nitrogen introduction tube and a dropping funnel, and the whole was stirred to system uniformity.

| | |
|---|---|
| Dimethylaminoethyl methacrylate | 36.5 parts |
| Lauryl bromide (quaternizing agent) | 63.5 parts |
| Ethanol | 50 parts |

The system was warmed up to 70° C. while under continued stirring, and was further stirred for 5 hours, to elicit monomer quaternization; as a result there could be obtained (2-methacryloyloxyethyl)lauryldimethyl ammonium bromide being a monomer containing a quaternary ammonium base. The obtained reaction solution was cooled, and thereafter 50 parts of ethanol as a solvent and 1.0 part of azobisisobutyronitrile (AIBN) as a polymerization initiator were changed into a dropping funnel, with stirring until system uniformity. The temperature in the reaction system was raised to 70° C. while under continued stirring, and the above ethanol solution containing the polymerization initiator, and having been charged in the dropping funnel, was added over 1 hour. Once dripping was over, the whole was left to react for 5 hours under reflux with nitrogen introduction. Thereafter, further 0.2 parts of AIBN were added, and the reaction was then left to proceed for 1 hour. The resulting solution was diluted with ethanol, to yield an additive resin solution having solids of 40%.

<Toner>

The toner used in the present example is one-component magnetic toner produced through suspension polymerization. The average circularity of the toner, as calculated using Expression 3 and Expression 4 below, is 0.96. The one-component magnetic toner used in the present example has at least a binder resin and a magnetic body.

$$\text{Circularity } (Ci) = \frac{\text{circumference length of circle having same projected area as particle image}}{\text{circumference length of projected image of particle}} \quad (3)$$

$$\text{Average circularity } (C) = \sum_{i=1}^{m} Ci/m \quad (4)$$

Average circularity is used as a simple method for representing quantitatively the shape of particles. In a case where average circularity is measured using a flow-type particle image analyzer "FPIA-1000", by Toa Medical Electronics Co., Ltd., the following definitions apply. The respective circularity (Ci) of particles measured for a particle group having a circle equivalent diameter of 3 μm or greater is worked out using Expression 3 above. Further, average circularity (C) is defined as the value resulting from dividing the total sum of the circularities of all the measured particles by the total particle number (m), as given in Expression 4. The average circularity is an index of the degree of unevenness of the toner. A perfectly spherical toner has an average circularity of 1.000; thus the more complex the surface shape of the toner, the smaller the average circularity becomes. In the present example 0.5 parts of strontium titanate as an external additive are added to the produced toner.

An image output endurance test with feeding of 10000 prints was carried out at an environment at 23° C./50%, using the image forming apparatus 100 according to the present example. For verification, a magnetic pole angle Θ (angle θ1 described above) of the magnetic pole S101 in the magnet roller 106 illustrated in FIG. 11 was set as follows.

(S1 Magnetic Pole Angle Θ of the Magnet Roller)

0°, 5°, 10°, 15°, 20°

Other conditions during image outputting were as follows.

(Other Conditions of the Magnet Roller)

Outer diameter: 8 mm

Peak magnetic flux density S1=700 G

S2=430 G

N1=540 G

N2=620 G (Image output conditions)

Process speed: 250 mm/sec

Development of the electrostatic latent image by jumping development

Developing sleeve outer diameter: 10.6 mm

Distance between developing sleeve and photoconductor drum: 300 μm

Charging application bias DC: −400 V, AC: sine wave, Vpp=1600 V, frequency=2700 Hz Developing bias DC: −300 V, AC: square wave, Vpp=1800 V, frequency=2300 Hz Photoconductor drum potential setting: dark portion potential (white background portion potential) VD=−350 V, bright portion potential (text portion potential) VL=−95 V

TABLE 4

| Paper feed | Angle of magnetic pole S101 and fogging on paper (%) | | | | |
|---|---|---|---|---|---|
| count | θ1 = 0° | θ1 = 5° | θ1 = 10° | θ1 = 15° | θ1 = 20° |
| Initial | 2.4 | 2.2 | 1.7 | 1.7 | 2.1 |
| After 10000 prints | 2.7 | 2.4 | 2.0 | 2.4 | 3.0 |

Table 4 sets out the results of the verification experiment. In the results of the verification experiment, fogging occurred in the image when the paper feed count was 10000 prints, in the image forming apparatus 100 with θ1 being 0° and in the image forming apparatus 100 with θ1 being 20°. In cases where θ1 was 5°, 10° and 15° no fogging occurred, even after the paper feed count reached 10000 prints. In particular, the occurrence of fogging until the paper feed count reached 10000 prints could be reduced the most when θ1 was 10°. This arises from the influence of the forces acting on the toner between the developing sleeve 151 and the photoconductor drum 101.

In a case where θ1 is 0° or 20°, the magnetic force acting in the downstream region N' is weak, and as a result the magnetic constraining force H2 acting on the toner is weak, and the amount of toner flying towards the photoconductor drum 101 increases in the downstream region N'. This resulted in an increase in fogging amount. In a case where, by contrast, θ1 is 5°, 10° or 15°, the magnetic force acting in the downstream region N' is strong, and accordingly the magnetic constraining force H2 acting on the toner is strong, and the amount of toner flying towards the photoconductor drum 101 decreases in the downstream region N'. This is deemed to result in a decrease in fogging amount. In the present example the range of θ1 must obey 0<θ1<Y. Specifically, in the present example there holds 0°<θ1<16° and preferably 4°<θ1<16°.

As is the case in Example 1, in Example 2 as well fogging can be reduced in a case where an electrostatic latent image is developed by relying on a jumping development scheme using toner in a cloud state. Moreover, toner consumption amount at edge portions of the electrostatic latent image can be reduced by bringing toner to a cloud state.

In Example 2 the developing sleeve 151 is formed out of a resin layer in which there are combined graphitized carbon black and acidic carbon black. Accordingly, the developing sleeve 151 can be imparted with lubricity, and as a result the toner can be charged uniformly.

In the various examples, the image carrier on which the electrostatic latent image is formed is not necessarily limited to being a photoconductor drum, and may be for instance a belt-like carrier. In that case, it suffices to set the position of the magnetic pole of the magnetic body with reference to the axis line of a tension roller that counteracts the developer carrier. The developer carrier that carries the toner as the developer is not necessarily limited to being a developing roller or a developing sleeve. In the examples, the developer for developing the electrostatic latent image is not necessarily limited to being toner. In the examples, moreover, the resin layer that makes up the developing roller is not necessarily limited to be shaped as a sleeve.

In the explanation thus far, fogging toner on the image carrier can be reduced by causing the highest magnetic flux density of a magnetic pole to be positioned downstream in the rotation direction, at a position facing the image carrier. As a result, it becomes possible to preserve image quality also at high output speeds. The position of highest magnetic flux density of the magnetic pole of the magnetic body lies preferably within the first region (developing region) or the second region (opposing region).

The present invention allows speeding up the image forming process while preserving image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-195428, filed on Sep. 30, 2015, which is hereby incorporated by reference herein in its entirety.

What is claimed is:

1. A developing apparatus, comprising:

developer for developing an electrostatic latent image formed on an image carrier; and a developer carrier on which the developer is carried, and which is disposed across a space from the image carrier, a magnetic body having a magnetic pole being provided inside the developer carrier, and the developer carried on the developer carrier being caused to fly between the image carrier and the developer carrier, and to adhere to the electrostatic latent image, thereby developing the electrostatic latent image, wherein the developer is a magnetic one-component polymerized developer;

in a cross-section of the developer carrier and the image carrier as viewed in an axis line direction of the developer carrier, with a first line segment being a line segment that joins an axis line of the developer carrier and an axis line of the image carrier, a second line segment being a line segment that joins the axis line of the developer carrier and a position exhibiting, on the surface of the developer carrier, maximal magnetic flux density of the magnetic pole for carrying the developer on the developer carrier, at a position opposing the image carrier, a first region being a region on the image carrier which is developed, in a case where developer is caused to fly between the image carrier and the developer carrier when DC voltage identical to DC voltage applied to the developer carrier when the electrostatic latent image is developed is applied to the developer carrier, with a potential of the image carrier set to 0 V, in a state where the image carrier and the developer carrier are not rotating, and a third line segment being a line segment that joins the axis line of the developer carrier and a downstream end portion, in a rotation direction of the developer carrier, of a second region which is a region on the developer carrier resulting from projecting, onto the developer carrier, the first region in a direction from the axis line of the image carrier towards the axis line of the developer carrier, then among angles in the rotation direction of the developer carrier, a first angle formed by the first line segment and the second line segment is greater than 0° and is equal to or smaller than a second angle formed by the first line segment and the third line segment.

2. The developing apparatus according to claim 1, comprising a developer regulating member that abuts the developer carrier.

3. The developing apparatus according to claim 1, wherein the rotation directions of the image carrier and of the developer carrier are mutually opposite, as viewed from one end of the axis line of the developer carrier.

4. The developing apparatus according to claim 3, wherein the image carrier rotates at a peripheral speed of 240 mm/sec or higher.

5. The developing apparatus according to claim 1, wherein a size of a clearance formed between the image carrier and the developer carrier in a region, at which the electrostatic latent image is developed, is larger than a height of the developer that is carried on the developer carrier.

6. The developing apparatus according to claim 1, wherein the first angle is equal to or smaller than an angle formed by the first line segment and a fourth line segment that joins a downstream end portion of the first region in the rotation direction of the image carrier, and the central axis of rotation of the developer carrier.

7. The developing apparatus according to claim 1, wherein the first angle is equal to an angle formed by the first line segment and a fourth line segment that joins a downstream end portion of the first region in the rotation direction of the image carrier and the central axis of rotation of the developer carrier.

8. The developing apparatus according to claim 1, wherein the developer carried on the developer carrier flies in the form of separate individual particles between the image carrier and the developer carrier.

9. The developing apparatus according to claim 1, wherein the developer is caused to oscillate between the developer carrier and the image carrier by change of a strength of an electric field generated between the developer carrier and the image carrier.

10. The developing apparatus according to claim 1, wherein the first angle lies in a range of 4° to 16°.

11. The developing apparatus according to claim 1, wherein an average circularity of the developer is 0.95 or higher.

12. The developing apparatus according to claim 11, wherein the developer is a magnetic developer that satisfies $3.2 \leq \sigma r \times D \leq 38.0$, where D (m) is a number-average particle size of the developer, and $\sigma r$ ($Am^2/kg$) is a residual magnetization of the developer in a magnetic field of 79.6 kA/m (1000 Oe).

13. The developing apparatus according to claim 1, wherein a resin layer is provided on a surface of the developer carrier; and developer is carried on the resin layer, the developing apparatus further comprising a developer regulating member that regulates an amount of developer carried on the resin layer, by coming into contact with the developer on the resin layer, wherein the resin layer is formed of a resin in which graphitized carbon black and acidic carbon black are combined.

14. The developing apparatus according to claim 13, wherein the resin layer is obtained by thermal curing of a coating material composition containing (A) to (E) below:

(A) a thermosetting resin as a binder resin;

(B) an alcohol having 1 to 4 carbon atoms as a solvent;

(C) a resin having units represented by Formula (R);

(D) graphitized carbon black having an interplanar spacing of the graphite (002) plane in a range of 0.3370 nm to 0.3450 nm, as measured by X-ray diffraction;

(E) acidic carbon black having pH of 5.0 or lower,

[Chem. 1]

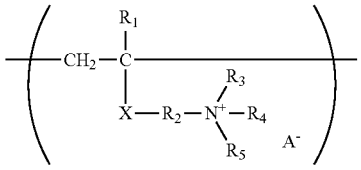

(R)

where in Formula (R), R1 represents a hydrogen atom or a methyl group, and R2 represents an alkylene group having 1 to 4 carbon atoms; one, two or more selected from among R3, R4 and R5 represents an alkyl group having 4 to 18 carbon atoms, and the other groups represent an alkyl group having 1 to 3 carbon atoms; X is any one of —COO—, —CONH— and —C6H4-, and A- represents an anion.

15. A process cartridge, comprising:

the developing apparatus according to claim 1; and the image carrier, wherein the process cartridge can be attached to and detached from an apparatus body of an image forming apparatus.

16. An image forming apparatus, comprising:

the developing apparatus according to claim 1, wherein the image forming apparatus forms an image on a recording medium.

17. A developing apparatus, comprising:

developer for developing an electrostatic latent image formed on an image carrier, wherein the developer is a magnetic one-component developer, and an average circularity of the developer is 0.95 or higher;

a developer carrier on which the developer is carried, and which is disposed across a space from the image carrier, a magnetic body having a magnetic pole being provided inside the developer carrier, and the developer carried on the developer carrier being caused to fly between the image carrier and the developer carrier, and to adhere to the electrostatic latent image, thereby developing the electrostatic latent image, wherein in a cross-section of the developer carrier and the image carrier as viewed in an axis line direction of the developer carrier, with a first line segment being a line segment that joins an axis line of the developer carrier and an axis line of the image carrier, a second line segment being a line segment that joins the axis line of the developer carrier and a position exhibiting, on the surface of the developer carrier, maximal magnetic flux density of the magnetic pole for carrying the developer on the developer carrier, at a position opposing the image carrier, wherein the second line segment is positioned downstream of the first line segment in a rotation direction of the developer carrier, and an angle between the first line segment and the second line segment lies in a range of 4° to 16° .

18. The developing apparatus according to claim 17, wherein the developer is a magnetic developer that satisfies $3.2 \leq \sigma r \times D \leq 38.0$, where D (μm) is a number-average particle size of the developer, and $\sigma r$ ($Am^2/kg$) is a residual magnetization of the developer in a magnetic field of 79.6 kA/m (1000 Oe).

19. The developing apparatus according to claim 17, wherein the image carrier rotates at a peripheral speed of 240 mm/sec or higher.

20. The developing apparatus according to claim 17, wherein a size of a clearance formed between the image carrier and the developer carrier in a region, at which the electrostatic latent image is developed, is larger than a height of the developer that is carried on the developer carrier.

21. The developing apparatus according to claim 17, wherein the developer carried on the developer carrier flies in the form of separate individual particles between the image carrier and the developer carrier.

22. The developing apparatus according to claim 21, wherein the developer is caused to oscillate between the developer carrier and the image carrier by change of a strength of an electric field generated between the developer carrier and the image carrier.

23. The developing apparatus according to claim 17, wherein a resin layer is provided on a surface of the developer carrier; and developer is carried on the resin layer, the developing apparatus further comprising a developer regulating member that regulates an amount of developer carried on the resin layer, by coming into contact with the developer on the resin layer, wherein the resin layer is formed of a resin in which graphitized carbon black and acidic carbon black are combined.

24. The developing apparatus according to claim 23, wherein the resin layer is obtained by thermal curing of a coating material composition containing (A) to (E) below:

(A) a thermosetting resin as a binder resin;

(B) an alcohol having 1 to 4 carbon atoms as a solvent;

(C) a resin having units represented by Formula (R);

(D) graphitized carbon black having an interplanar spacing of the graphite (002) plane in a range of 0.3370 nm to 0.3450 nm, as measured by X-ray diffraction;

(E) acidic carbon black having pH of 5.0 or lower,

[Chem. 1]

(R)

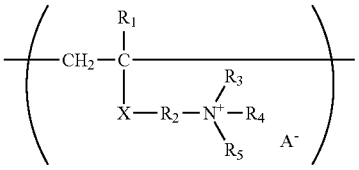

where in Formula (R), R1 represents a hydrogen atom or a methyl group, and R2 represents an alkylene group having 1 to 4 carbon atoms; one, two or more selected from among R3, R4 and R5 represents an alkyl group having 4 to 18 carbon atoms, and the other groups represent an alkyl group having 1 to 3 carbon atoms; X is any one of —COO—, —CONH— and —C6H4—, and A— represents an anion.

* * * * *